US010203664B2

(12) United States Patent
Sakumoto et al.

(10) Patent No.: US 10,203,664 B2
(45) Date of Patent: Feb. 12, 2019

(54) ELECTRONIC TIMEPIECE

(71) Applicant: SEIKO INSTRUMENTS INC., Chiba-shi, Chiba (JP)

(72) Inventors: Kazumi Sakumoto, Chiba (JP); Kotaro Watanabe, Chiba (JP); Minoru Sano, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 229 days.

(21) Appl. No.: 15/244,178

(22) Filed: Aug. 23, 2016

(65) Prior Publication Data

US 2017/0060096 A1 Mar. 2, 2017

(30) Foreign Application Priority Data

Aug. 28, 2015 (JP) ..... 2015-169304

(51) Int. Cl.
*G04G 19/12* (2006.01)

(52) U.S. Cl.
CPC ..... *G04G 19/12* (2013.01)

(58) Field of Classification Search
CPC ..... G04G 19/12
USPC ..... 368/187, 321
See application file for complete search history.

(56) References Cited

U.S. PATENT DOCUMENTS 3,745,760 A * 7/1973 Keeler ..... G04G 19/12 368/157
4,065,916 A * 1/1978 Leuschner ..... G04G 5/04 368/70
4,177,632 A * 12/1979 Burki ..... G04G 19/12 368/187
4,351,042 A * 9/1982 Ginalski ..... G04G 19/12 368/188
4,470,706 A * 9/1984 Nishimura ..... G04C 3/14 368/251
4,615,625 A * 10/1986 Moriya ..... G04G 19/12 368/156
6,542,440 B1 * 4/2003 Kihara ..... G04G 19/12 368/156

OTHER PUBLICATIONS

Abstract, Publication No. JP 2001-109734, Publication date Apr. 20, 2001.

* cited by examiner

*Primary Examiner* — Edwin A. Leon
*Assistant Examiner* — Jason Collins
(74) *Attorney, Agent, or Firm* — Adams & Wilks

(57) ABSTRACT

An electronic timepiece includes a first switch connected to a signal line, a second switch, and a one-shot pulse signal generation circuit. The first switch is inserted into the signal line. One end of the second switch is connected to the signal line at a rear stage of the first switch, and the other end of the second switch is connected to a power source. The one-shot pulse signal generation circuit generates a one-shot pulse signal by using a reference clock signal, and the second switch is controlled by the one-shot pulse signal. The timepiece device can reduce currents flowing in a pull-down resistor or a pull-up resistor when a crown switch is turned on.

13 Claims, 10 Drawing Sheets

2 OSCILLATOR CIRCUIT
3 FREQUENCY DIVIDER CIRCUIT
4 CONTROL CIRCUIT
5 CLOCKING DRIVE UNIT
1 CROWN SWITCH DETECTION CIRCUIT
6 CLOCKING UNIT

ELECTRONIC TIMEPIECE

BACKGROUND OF THE INVENTION

Field of the Invention

The present invention relates to an electronic timepiece.

Background Art

In a case where an analog display electronic timepiece is stored or displayed while being normally operated, a mechanism for counting the time is driven. Consequently, in some cases, battery life is no longer preserved within approximately two years. Therefore, in some cases, in order to prolong the battery life, a crown is pulled out and a mode for stopping an operation of the electronic timepiece is used in a store. However, even in this case, a signal line to check whether the crown is turned on or turned off is pulled up or pulled down, thereby consuming current power. Hereinafter, this configuration will be described with reference to FIG. 10.

FIG. 10 is a circuit diagram illustrating a configuration of a crown switch detection circuit 500 in the electronic timepiece in the related art. In the circuit illustrated in FIG. 10, a reference potential Vdd is a voltage higher than a power source Vss. In FIG. 10, a crown switch 511 is inserted between one end of a signal line 512 and the reference potential Vdd. The other end of the signal line 512 is connected to a crown switch detection terminal 515 via an inverter 513 and an inverter 514.

As a pull-down resistor, an N-channel MOS transistor 516 and an N-channel MOS transistor 517 are inserted between the signal line 512 and the power source Vss. On-resistance of the N-channel MOS transistor 516 is greater than on-resistance of the N-channel MOS transistor 517. A gate of the N-channel MOS transistor 516 is connected to the reference potential Vdd. An output signal of a NAND gate 519 is supplied to a gate of the N-channel MOS transistor 517.

An output signal of the inverter 514 is supplied to one input terminal of the NAND gate 519. A system reset signal SRX is supplied from a system reset terminal 518 to the other input terminal of the NAND gate 519. The system reset signal SRX is supplied from a control circuit 4 (FIG. 2).

When the crown is in an inserted state, the crown switch 511 is turned off. When the crown switch 511 is turned off, one end of the signal line 512 is opened. In this case, since the gate of the N-channel MOS transistor 516 is the reference potential Vdd, the N-channel MOS transistor 516 is turned on. Accordingly, the signal line 512 is pulled down to a low level by the N-channel MOS transistor 516. In this manner, a crown switch detection signal K1IN output from the crown switch detection terminal 515 is in a low level.

At the time of initial setting, the system reset signal SRX output from the system reset terminal 518 is in a low level, and power-on reset is performed. If the system reset signal SRX output from the system reset terminal 518 is in a low level, the output signal of the NAND gate 519 is in a high level, thereby turning on the N-channel MOS transistor 517. If the N-channel MOS transistor 517 is turned on, the N-channel MOS transistor 517 functions as the pull-down resistor, and the signal line 512 is pulled down to a low level.

During normal operation, the system reset signal SRX output from the system reset terminal 518 is in a high level. In addition, the crown is in a pressed state, and thus, the crown switch 511 is turned off. Since the N-channel MOS transistor 516 is always turned on, the signal line 512 is connected via the N-channel MOS transistor 516, and is pulled down to a low level, thereby bringing the output signal of the inverter 514 to a low level. In addition, at the time of the normal operation, the system reset signal SRX output from the system reset terminal 518 is in a high level. Therefore, the output signal of the NAND gate 519 is in a high level. The N-channel MOS transistor 517 is turned on, and the signal line 512 is pulled down to a low level.

In this way, during normal operation, the signal line 512 is pulled down to a low level by the N-channel MOS transistor 516 and the N-channel MOS transistor 517, thereby bringing the crown switch detection signal K1IN output from the crown switch detection terminal 515 into a low level. The ON-resistance of the N-channel MOS transistor 517 is smaller than the ON-resistance of the N-channel MOS transistor 516. Accordingly, the N-channel MOS transistor 517 dominantly functions as the pull-down resistor. In this way, the signal line 512 is pulled down by the N-channel MOS transistor 517 having the smaller ON-resistance. Therefore, the electronic timepiece can be hardly affected by noise.

Next, if the crown is pulled out while the system is operated, the crown switch 511 is turned on. If the crown switch 511 is turned on, one end of the signal line 512 is connected to the reference potential Vdd via the crown switch 511. This brings the signal line 512 into a high level.

If the signal line 512 is in a high level, an output of the inverter 514 is in a high level, and the crown switch detection signal K1IN output from the crown switch detection terminal 515 is in a high level. In addition, while the system is operated, the system reset signal SRX is in a high level. Accordingly, the output signal of the NAND gate 519 is in a low level, and the N-channel MOS transistor 517 is turned off. Therefore, the N-channel MOS transistor 517 no longer functions as the pull-down resistor.

In this case, although the N-channel MOS transistor 516 is turned on, the ON-resistance of the N-channel MOS transistor 516 is great. Therefore, a small amount of currents flows via the N-channel MOS transistor 516.

In this way, in the crown switch detection circuit 500 of the electronic timepiece in the related art illustrated in FIG. 10, if the crown is pulled out, the crown switch 511 is turned on. One end of the signal line 512 is connected to the reference potential Vdd via the crown switch 511, and the crown switch detection signal K1IN output from the crown switch detection terminal 515 is in a high level. A control circuit of the timepiece detects that the crown switch detection signal K1IN is in a high level, and employs a mode for stopping an operation of the timepiece. In this mode, time adjustment can be done by rotating the crown. In addition, it is possible to prolong the battery life by storing or displaying the timepiece which employs the mode for stopping the operation of the timepiece.

However, in the crown switch detection circuit 500 of the electronic timepiece in the related art illustrated in FIG. 10, even while the crown switch 511 is turned on and the signal line 512 is in a high level, the N-channel MOS transistor 516 used for pull-down is turned on. Consequently, currents flow via the N-channel MOS transistor 516. An ON-resistance value of the N-channel MOS transistor 516 is great. Thus, a small amount of currents flows via the N-channel MOS transistor 516. However, in a case where the timepiece is displayed after the crown is pulled out, the small amount of currents also affects the battery life.

In order to further reduce the currents flowing in the N-channel MOS transistor 516 when the crown switch 511 is turned on, it is conceivable to increase the ON-resistance of the N-channel MOS transistor 516. However, if the ON-resistance value is increased in the N-channel MOS transistor 516 functioning as the pull-down resistor, a problem arises in that a chip area increases. Therefore, as disclosed in JP-A-2001-109734, a proposal is suggested in which a switching element for driving a pull-down function or a pull-up function is periodically turned on and off.

As disclosed in JP-A-2001-109734, in a case where the switch for pull-down or pulled-up is periodically turned on and off, if a time required for turning on the switch for pull-down or pulled-up is shortened, an advantageous effect increases in reducing current consumption. For example, if the switch is turned on as much as a width of 122 usec per frequency of 128 Hz, when a power source voltage is 1.55 V and the ON-resistance is 2 M?, current consumption of 12.1 nA can be realized while the switch is turned on as much as the width of 122 usec. However, even in this case, the current consumption is approximately 12 nA, and there is a need to further reduce the current consumption. In this case, it is necessary to more quickly switch the switching element for pull-down or pull-up. In a case of the electronic timepiece, it is considered that a switching signal of the switching element is formed of an oscillation signal of a quartz resonator. A signal having a frequency which is equal to or smaller than an oscillation frequency of the quartz resonator can be formed by dividing the oscillation signal of the quartz resonator. However, it is necessary to generate the switching signal for quickly switching the switching element by combining each signal of a frequency divider circuit. Parasitic capacitance of a transistor configuring a combination circuit thereof is charged and discharged using a quick signal. Consequently, there is a problem in that the charging and discharging current increases the current consumption.

SUMMARY OF THE INVENTION

In view of the above-described problems, an object of the present invention is to provide a timepiece device which can reduce currents flowing in a pull-up resistor or a pull-down resistor when a crown switch is turned on.

According to an aspect of the present invention, in order to achieve the above-described object, there is provided an electronic timepiece including a first switch that is connected to a signal line, a second switch, and a one-shot pulse signal generation circuit. The first switch is inserted into the signal line. One end of the second switch is connected to the signal line on a rear stage of the first switch. The other end of the second switch is connected to a power source. The one-shot pulse signal generation circuit generates a one-shot pulse signal by using a reference clock signal. The second switch is controlled by the one-shot pulse signal.

In the aspect, the electronic timepiece may further include an oscillator circuit, and a clocking unit that clocks a time, based on a frequency in which a frequency obtainable from the oscillator circuit is divided. The reference clock signal may be configured to include the frequency in which the frequency obtainable from the oscillator circuit is divided. The first switch may select a connection state and a disconnection state by operating a crown.

In the aspect, the one-shot pulse signal generation circuit may include a first inverter, a second inverter, a capacitor, and a NAND gate. The reference clock signal may be input to an input terminal of the first inverter. An input terminal of the second inverter and one input terminal of the NAND gate may be connected to an output terminal of the first inverter. One end of the capacitor and the other input terminal of the NAND gate may be connected to an output terminal of the second inverter. The other end of the capacitor may be connected to a reference potential. Based on an output signal of the NAND gate, the one-shot pulse signal generation circuit may generate a high level signal having a period shorter than a period while the reference clock signal is in a high level.

In the aspect, the capacitor may be formed by capacitance using a gate oxide film. A transistor configuring the second inverter may delay falling of the reference clock signal by charging and discharging the capacitor. A pulse width during a period while the one-shot pulse signal is in a high level may be determined by the capacitance of the capacitor and driving ability of the transistor configuring the second inverter.

In the aspect, the second switch maybe used as a first pull-down resistor so as to control a function of the first pull-down resistor in accordance with the one-shot pulse signal.

In the aspect, a first pull-down resistor may be inserted between the signal line and the second switch so as to control a function of the first pull-down resistor in accordance with the one-shot pulse signal.

In the aspect, a second pull-down resistor may be inserted between the signal line and the power source so as to control a function of the second pull-down resistor in accordance with an output level and a reset signal of the signal line.

In the aspect, a third switch for connecting the signal line and the reference potential may be inserted between the signal line and the reference potential so as to operate the third switch with the second switch in a complementary manner.

According to another aspect of the present invention, there is provided an electronic timepiece including a first switch that is connected to a signal line, a second switch, and a one-shot pulse signal generation circuit. The first switch is inserted into the signal line. One end of the second switch is connected to the signal line on a rear stage of the first switch. The other end of the second switch is connected to a reference potential. The one-shot pulse signal generation circuit generates a one-shot pulse signal by using a reference clock signal. The second switch is controlled by the one-shot pulse signal.

In the aspect, the electronic timepiece may further include an oscillator circuit, and a clocking unit that clocks a time, based on a frequency in which a frequency obtainable from the oscillator circuit is divided. The reference clock signal maybe configured to include the frequency in which the frequency obtainable from the oscillator circuit is divided. The first switch may select a connection state and a disconnection state by operating a crown.

In the aspect, the one-shot pulse signal generation circuit may include a first inverter, a second inverter, a capacitor, and a NOR gate. The reference clock signal may be input to an input terminal of the first inverter, and an input terminal of the second inverter and one input terminal of the NOR gate are connected to an output terminal of the first inverter. One end of the capacitor and the other input terminal of the NOR gate may be connected to an output terminal of the second inverter. The other end of the capacitor may be connected to a reference potential. Based on an output signal of the NOR gate, the one-shot pulse signal generation circuit may generate a low level signal having a period shorter than a period while the reference clock signal is in a low level.

In the aspect, the capacitor may be formed by capacitance using a gate oxide film. A transistor configuring the second inverter may delay falling of the reference clock signal by charging and discharging the capacitor. A pulse width during a period while the one-shot pulse signal is in a low level may be determined by the capacitance of the capacitor and driving ability of the transistor configuring the second inverter.

In the aspect, the second switch may be used as a first pull-up resistor so as to control a function of the first pull-up resistor in accordance with the one-shot pulse signal.

In the aspect, a second pull-up resistor may be inserted between the signal line and the reference potential so as to control a function of the second pull-up resistor in accordance with an output level and a reset signal of the signal line.

In the aspect, a third switch for connecting the signal line and the power source may be inserted between the signal line and the power source so as to operate the third switch with the second switch in a complementary manner.

According to the present invention, when a crown is pulled out and a crown switch is turned on, it is possible to considerably reduce currents flowing in a pull-up resistor or a pull-down resistor. This can prolong battery life in a case where an electronic timepiece is displayed while the crown is pulled out in a store, for example.

DETAILED DESCRIPTION OF THE INVENTION

Hereinafter, embodiments according to the present invention will be described with reference to the drawings.

Figure 1:
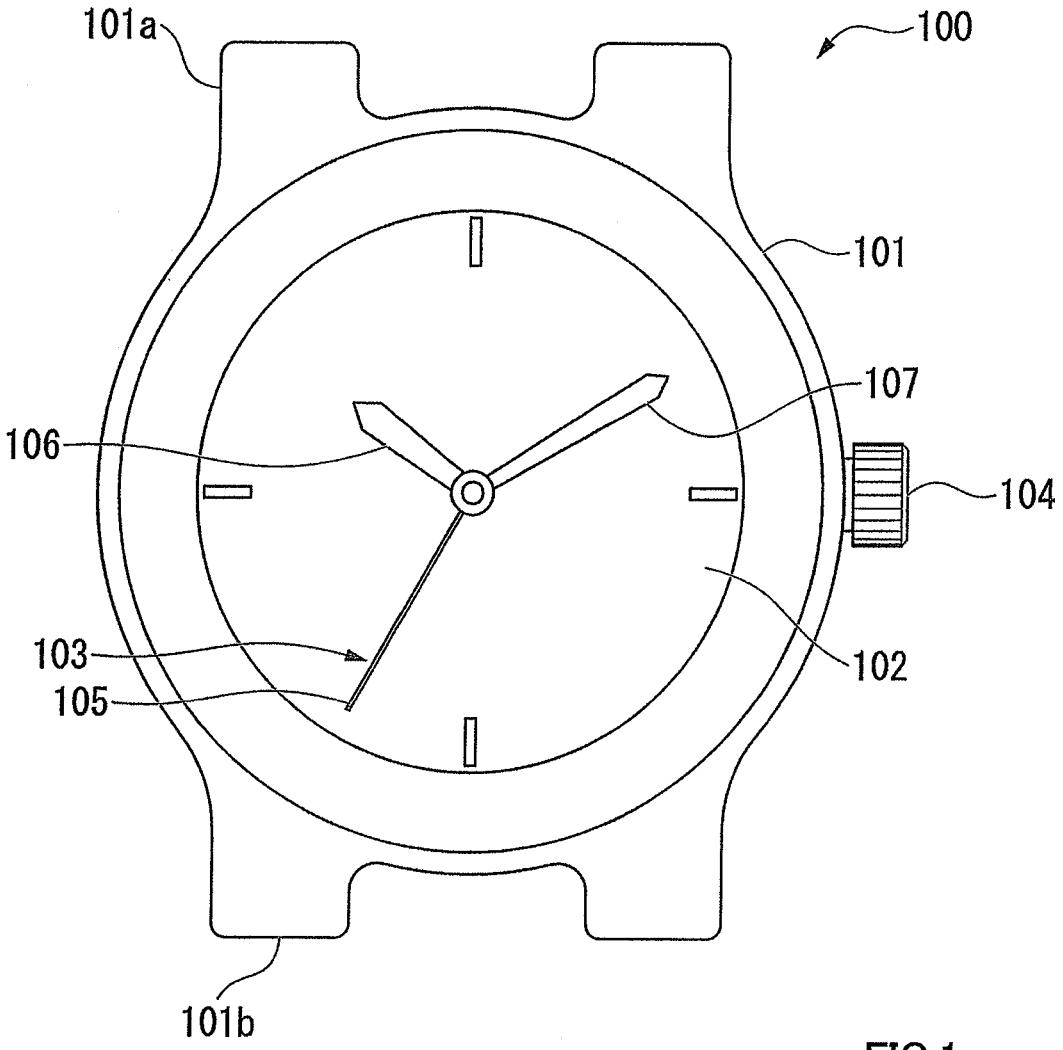
FIG. 1 is a plan view of an electronic timepiece including a solar cell panel according to the present invention.

FIG. 1 is a plan view of an electronic timepiece 100 including a solar cell panel according to the present invention.

As illustrated in FIG. 1, the electronic timepiece 100 includes an exterior case 101, a dial 102, an indicating hand 103, and a crown 104.

Band attachment portions 101*a* and 101*b* for respectively attaching a timepiece band (not illustrated) to a 6 o'clock side and a 12 o'clock side are formed on a side surface of the exterior case 101. The crown 104 is disposed on a 3 o'clock position side on the side surface of the exterior case 101. The indicating hand 103 is arranged on the dial 102 disposed on an outer surface of the exterior case 101, and includes a second hand 105, a minute hand 106, and an hour hand 107.

First Embodiment

First, a configuration of the electronic timepiece 100 will be described.

Figure 2:
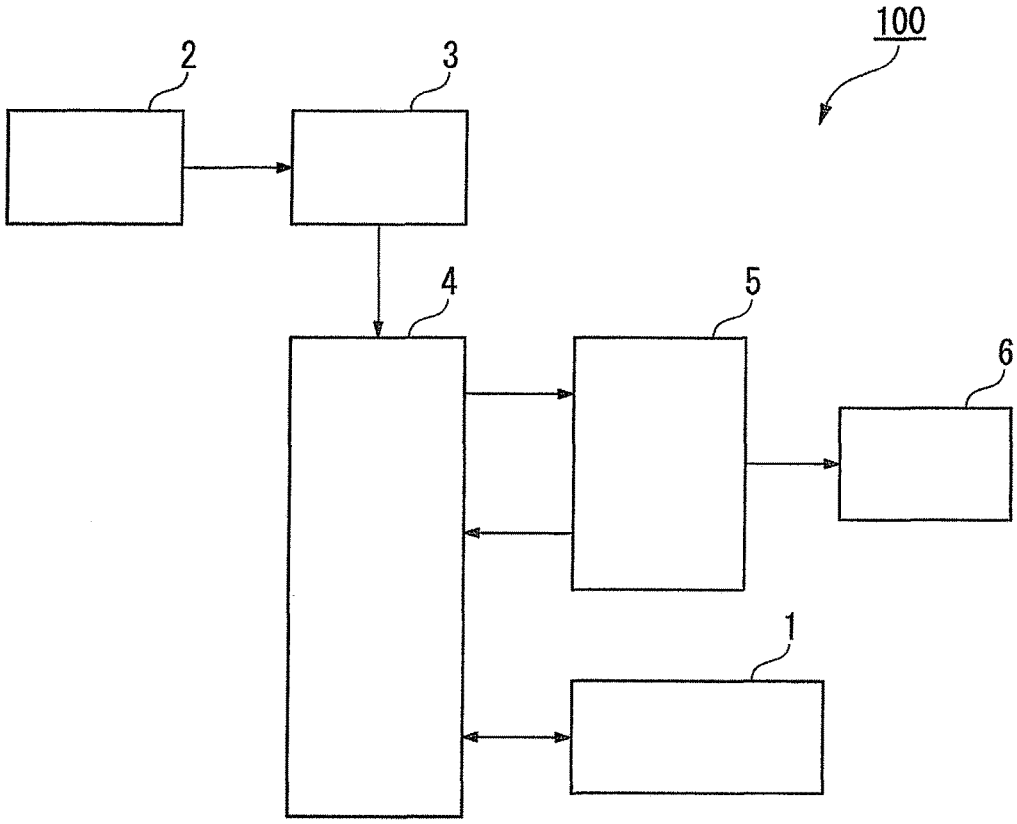
FIG. 2 is a block diagram illustrating a configuration of an electronic timepiece according to a first embodiment.

FIG. 2 is a block diagram illustrating a configuration of the electronic timepiece 100 according to the present embodiment. As illustrated in FIG. 2, the electronic timepiece 100 includes a crown switch detection circuit 1, an oscillator circuit 2, a frequency divider circuit 3, a control circuit 4, a clocking drive unit 5, and a clocking unit 6.

The crown switch detection circuit 1 generates a crown switch detection signal K1IN (to be described later) in accordance with an operation of the crown 104 (FIG. 1), and outputs the generated crown switch detection signal K1IN to the control circuit 4. A configuration and an operation of the crown switch detection circuit 1 will be described later.

The oscillator circuit 2 includes a quartz resonator, and generates an oscillation clock signal having a predetermined frequency (for example, 32768 Hz) based on vibrations of the quartz resonator. The oscillator circuit 2 outputs the generated oscillation signal to the frequency divider circuit 3. The frequency divider circuit 3 generates a clocking reference signal and a reference clock signal SMP which are used for clocking by dividing the oscillation signal input from the oscillator circuit 2. For example, a drive frequency of the clocking reference signal is 1 Hz. For example, a frequency of the reference clock signal SMP is 128 Hz. The frequency divider circuit 3 outputs the generated clocking reference signal to the control circuit 4. In addition, the frequency divider circuit 3 outputs the generated reference clock signal SMP to the crown switch detection circuit 1.

The control circuit 4 clocks a time by using a reference signal input from the frequency divider circuit 3. The clocking result indicates the current time. The control circuit 4 outputs clocking information indicating the clocking result to the clocking drive unit 5. In addition, the control circuit 4 generates a control instruction for the clocking unit 6, based on the crown switch detection signal K1IN output from the crown switch detection circuit 1, and outputs the generated control instruction to the clocking drive unit 5. The control instruction means an instruction to stop driving the indicating hand 103 and an instruction to restart driving the indicating hand 103. In addition, based on a pattern of an induced signal output from the clocking drive unit 5, the control circuit 4 determines a rotation status of a stepping motor (not illustrated) belonging to the clocking drive unit 5. In a case where correction drive is needed based on the determination result, the control circuit 4 generates an auxiliary drive pulse, and outputs the generated auxiliary drive pulse to the clocking drive unit 5.

The clocking drive unit 5 is configured to include a drive circuit, a stepping motor, a train wheel, and a rotation detection and determination circuit (not illustrated). The clocking drive unit 5 drives the clocking unit 6 in accordance with the clocking information output from the control circuit 4. In addition, the rotation detection and determination circuit of the clocking drive unit 5 detects the induced signal generated by free vibrations when the stepping motor is rotatably driven, and outputs the pattern of the induced signal which indicates a drive state whether or not the stepping motor is rotated, to the control circuit 4.

The clocking unit 6 includes the indicating hand 103 (FIG. 1), and is driven, stopped, or restarted for driving by the clocking drive unit 5.

Next, a configuration of the crown switch detection circuit 1 will be described.

Figure 3:
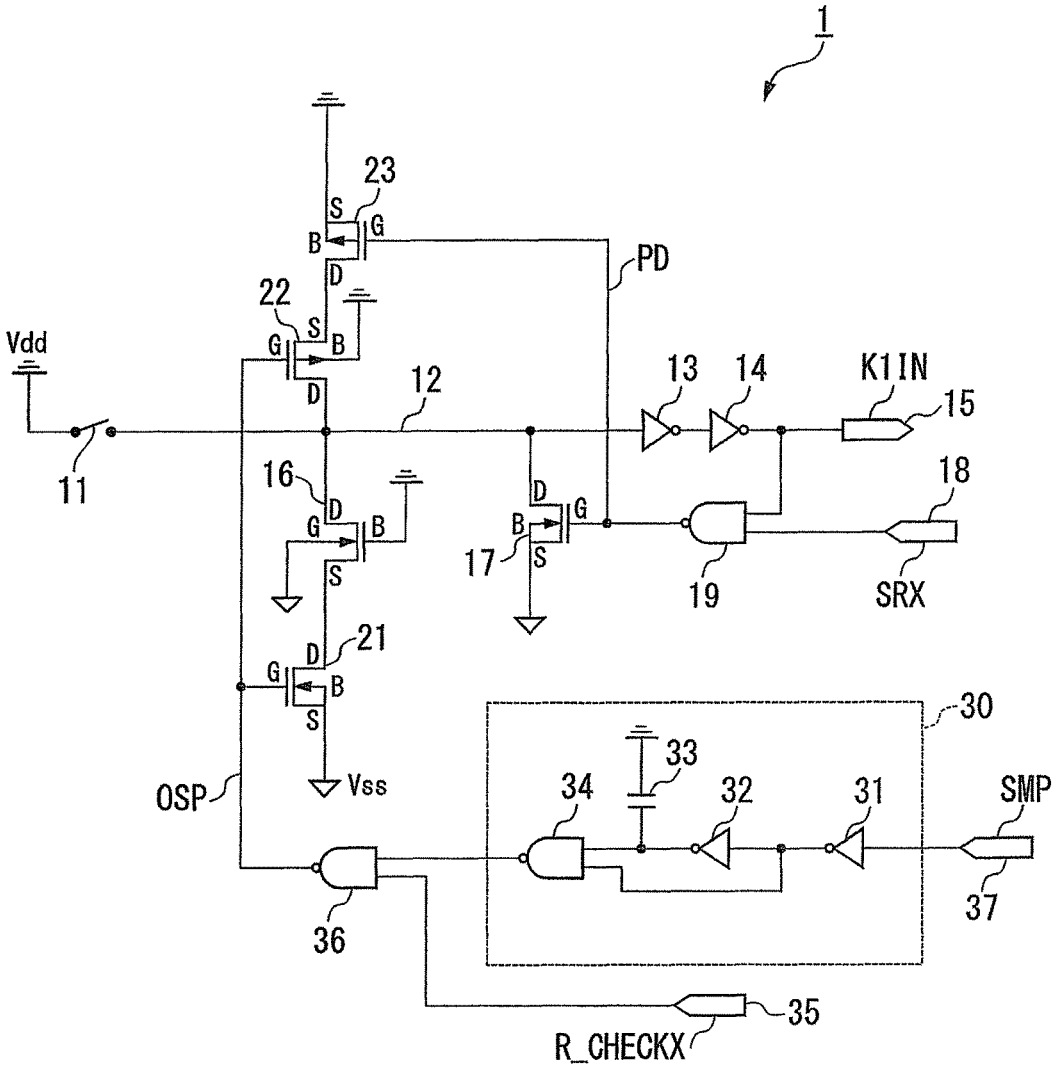
FIG. 3 is a circuit diagram illustrating a configuration of a crown switch detection circuit in the timepiece device according to the first embodiment.

FIG. 3 is a circuit diagram illustrating the configuration of the crown switch detection circuit 1 in the timepiece device according to the present embodiment. In the circuit illustrated in FIG. 3, a reference potential Vdd has a voltage which is higher than a power source Vss. For example, the power source Vss is −1.55 V.

In accordance with the operation of the crown 104 (FIG. 1), a crown switch 11 can mechanically or electrically select a connection state and a disconnection state. For example, the crown switch 11 switches the crown 104 to a turned-off state when the crown 104 is pressed, and switches the crown 104 to a turned-on state when the crown 104 is pulled out. In addition, as illustrated in FIG. 3, the crown switch 11 is inserted between one end of a signal line 12 and a reference potential Vdd. The other end of the signal line 12 is connected to a crown switch detection terminal 15 via an inverter 13 and an inverter 14. The crown switch detection signal K1IN is output from the crown switch detection terminal 15. The crown switch detection signal K1IN is a signal for detecting a turned-on state and a turned-off state of the crown switch 11.

An N-channel MOS transistor 16 and an N-channel MOS transistor 21 are inserted between the signal line 12 and a power source Vss. In addition, an N-channel MOS transistor 17 is inserted between the signal line 12 and the power source Vss. The N-channel MOS transistor 16 and the N-channel MOS transistor 17 function as a pull-down resistor of the signal line 12. A gate (G) of the N-channel MOS transistor 16 is connected to the reference potential Vdd. In the N-channel MOS transistor 16, a drain (D) thereof is connected to the signal line 12, a source (S) thereof is connected to the drain of the N-channel MOS transistor 21, and a body (B) (also referred to as a back gate) is connected to the power source Vss. The source and the body of the N-channel MOS transistor 21 are connected to the power source Vss. A one-shot pulse signal OSP is supplied from a NAND gate 36 to the gate of the N-channel MOS transistor 21. In the N-channel MOS transistor 17, the drain is connected to the signal line 12, and the source and the body are connected to the power source Vss. An output signal PD of a NAND gate 19 is supplied to the gate of the N-channel MOS transistor 17.

In addition, a P-channel MOS transistor 22 and a P-channel MOS transistor 23 are inserted between the signal line 12 and the reference potential Vdd. In the P-channel MOS transistor 22, the drain is connected to the signal line 12, the source is connected to the drain of the P-channel MOS transistor 23, and the body is connected to the reference potential Vdd. The one-shot pulse signal OSP is supplied from the NAND gate 36 to the gate of the P-channel MOS transistor 22. In the P-channel MOS transistor 23, the source and the body are connected to the reference potential Vdd. The output signal PD of the NAND gate 19 is supplied to the gate of the P-channel MOS transistor 23.

An output signal of the inverter 14 is supplied to one input terminal of the NAND gate 19. A system reset signal SRX is supplied from a system reset terminal 18 to the other input terminal of the NAND gate 19. The system reset signal SRX is a signal for power-on reset. The system reset signal SRX is in a high level while the system is operated, and is in a low level during the power-on reset. In the inverter 13, the input terminal is connected to the signal line 12, and the output terminal is connected to the input terminal of the inverter 14.

A one-shot pulse signal generation circuit 30 is configured to include an inverter 31, an inverter 32, a capacitor 33, and a NAND gate 34. In the inverter 31, the reference clock signal SMP is input to the input terminal, and the input terminal of the inverter 32 and one input terminal of the NAND gate 34 are connected to the output terminal. In the inverter 32, one end of the capacitor 33 and the other input terminal of the NAND gate 34 are connected to the output terminal. The other end of the capacitor 33 is connected to the reference potential. The capacitor 33 can be formed by using capacitance of a gate oxide film of a MOS transistor.

The reference clock signal SMP is supplied from a reference clock terminal 37 to the one-shot pulse signal generation circuit 30. The output signal of the NAND gate 34 of the one-shot pulse signal generation circuit 30 is supplied to one input terminal of the NAND gate 36. A check signal R_CHECKX is supplied from a check signal input terminal 35 to the other input terminal of the NAND gate 36. The check signal R_CHECKX is a signal for checking the pull-down resistor, and is normally in a high level. When the pull-down resistor is checked, the check signal R_CHECKX is in a low level.

The one-shot pulse signal OSP is output from the NAND gate 36. The one-shot pulse signal OSP is supplied to the gate of the N-channel MOS transistor 21 and the gate of the P-channel MOS transistor 22.

Figure 4:
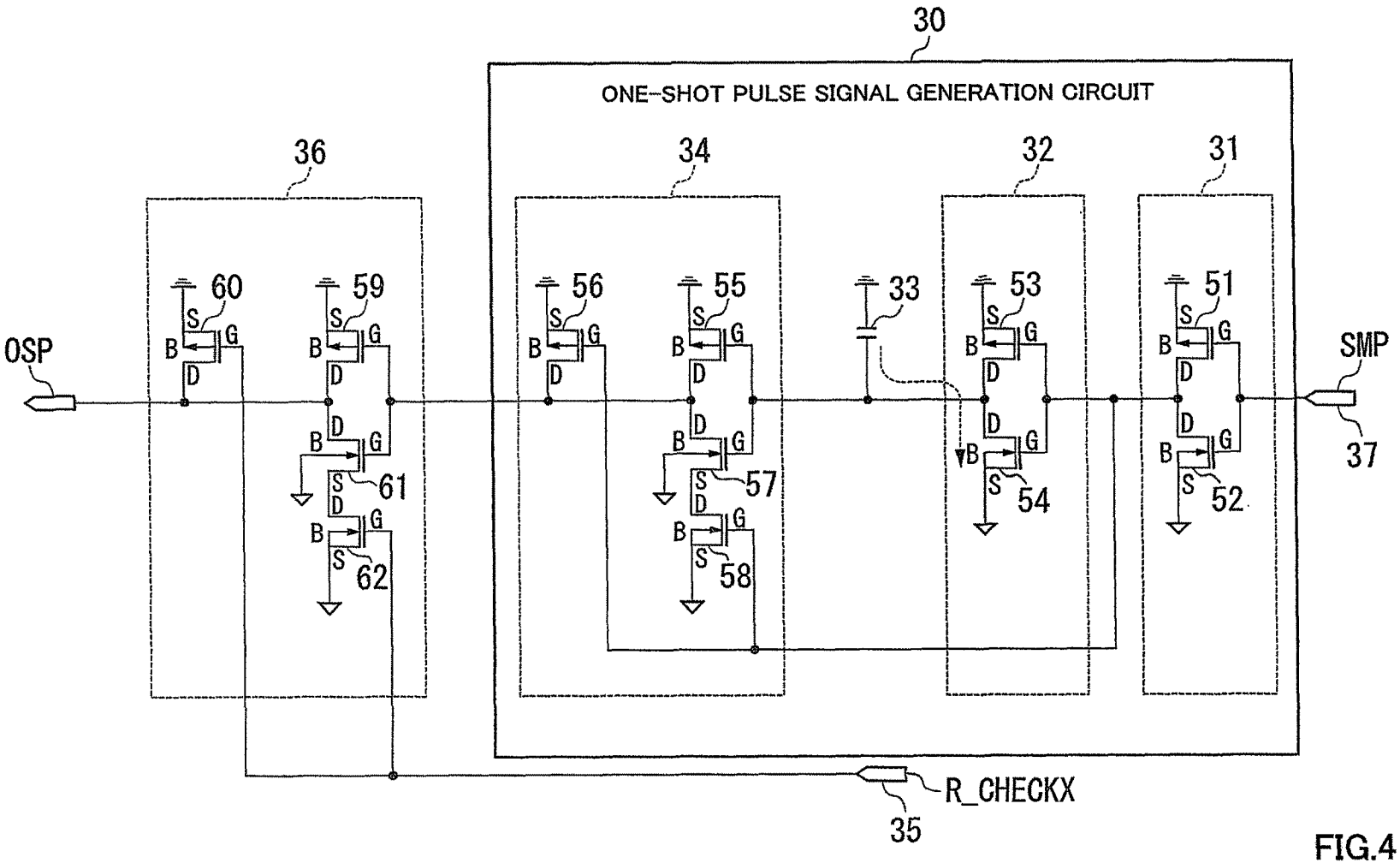
FIG. 4 is a circuit diagram illustrating a specific example of a one-shot pulse signal generation circuit according to the first embodiment.

FIG. 4 is a circuit diagram illustrating an example of the one-shot pulse signal generation circuit 30 according to the present embodiment. As illustrated in FIG. 4, the inverter 31 is configured to include a complementary MOS (CMOS) inverter having a P-channel MOS transistor 51 and an N-channel MOS transistor 52. In the P-channel MOS transistor 51, the drain is connected to the drain of the N-channel MOS transistor 52, and the source and the body are connected to the reference potential. The reference clock signal SMP is connected to the gate of the P-channel MOS transistor 51 and the gate of the N-channel MOS transistor 52. In the N-channel MOS transistor 52, the source and the body are connected to the power source Vss.

The inverter 32 is configured to include a CMOS inverter having a P-channel MOS transistor 53 and an N-channel MOS transistor 54. An intersection point between the drain of the P-channel MOS transistor 51 and the drain of the N-channel MOS transistor 52 is connected to the gate of the P-channel MOS transistor 53 and the gate of the N-channel MOS transistor 54. In the P-channel MOS transistor 53, the drain is connected to the drain of the N-channel MOS transistor 54, and the source and the body are connected to the reference potential. In the N-channel MOS transistor 54, the source and the body are connected to the power source Vss. An intersection point between the drain of the P-channel MOS transistor 53 and the drain of the N-channel MOS transistor 54 is connected to one end of the capacitor 33.

The NAND gate 34 is configured to include a NAND gate of CMOS having P-channel MOS transistors 55 and 56 and N-channel MOS transistors 57 and 58. An intersection point among the drain of the P-channel MOS transistor 53, the drain of the N-channel MOS transistor 54, and one end of the capacitor 33 is connected to the gate of the P-channel MOS transistor 55 and the gate of the N-channel MOS transistor 57. In the P-channel MOS transistor 55, the drain is connected to the drain of the N-channel MOS transistor 57, and the source and the body are connected to the reference potential. In the N-channel MOS transistor 57, the source is connected to the drain of an N-channel MOS transistor 58, and the body is connected to the power source Vss. In the N-channel MOS transistor 58, the gate is connected to the intersection point between the drain of the P-channel MOS transistor 51 and the drain of the N-channel MOS transistor 52, and the source and the body are connected to the power source Vss. In a P-channel MOS transistor 56, the drain is connected to an intersection point between the drain of the P-channel MOS transistor 55 and the drain of the N-channel MOS transistor 57, the gate is connected to the intersection point between the drain of the P-channel MOS transistor 51 and the drain of the N-channel MOS transistor 52, and the source and the body are connected to the reference potential.

The NAND gate 36 is configured to include a NAND gate of CMOS having P-channel MOS transistors 59 and 60 and N-channel MOS transistors 61 and 62. An intersection point among the drain of the P-channel MOS transistor 55, the drain of the N-channel MOS transistor 57, and the drain of the P-channel MOS transistor 56 is connected to the gate of the P-channel MOS transistor 59 and the gate of the N-channel MOS transistor 61. In the P-channel MOS transistor 59, the drain is connected to the drain of the N-channel MOS transistor 61, and the source and the body are connected to the reference potential. In the N-channel MOS transistor 61, the source is connected to the drain of the N-channel MOS transistor 62, and the body is connected to the power source Vss. In the N-channel MOS transistor 62, the gate is connected to the check signal input terminal 35, and the source and the body are connected to the power source Vss. In the P-channel MOS transistor 60, the drain is connected to an intersection point between the drain of the P-channel MOS transistor 59 and the drain of the N-channel MOS transistor 61, the gate is connected to the check signal input terminal 35, and the source and the body are connected to the reference potential. An intersection point among the drain of the P-channel MOS transistor 59, the drain of the N-channel MOS transistor 61, and the drain of the P-channel MOS transistor 60 is an output of the NAND gate 36, and is the one-shot pulse signal OSP.

Figure 5:
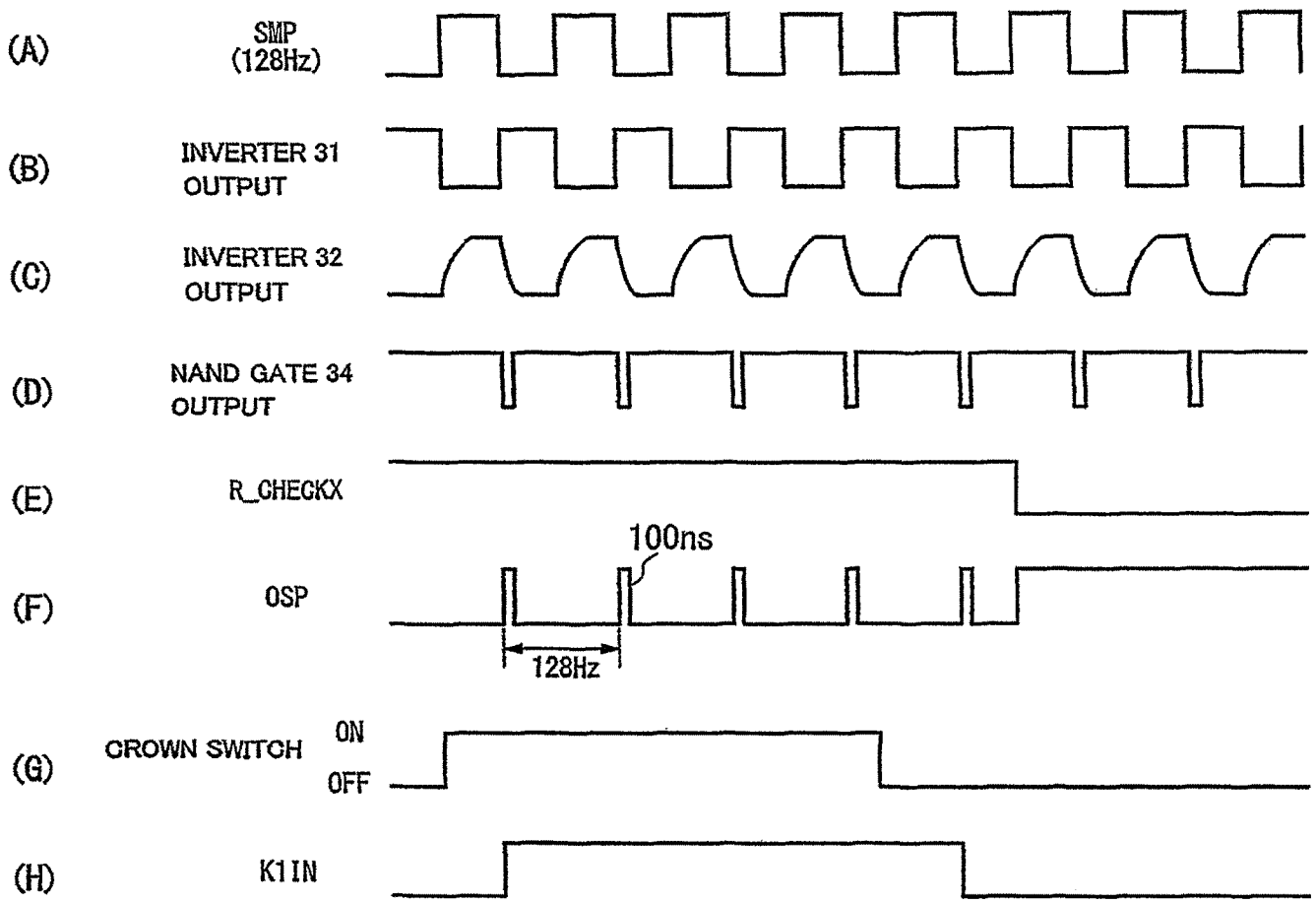
FIGS. 5A to 5H are waveform charts illustrating an operation of the one-shot pulse signal generation circuit according to the first embodiment.

FIGS. 5A to 5H are waveform charts illustrating an operation of the one-shot pulse signal generation circuit 30 according to the present embodiment. The reference clock signal SMP as illustrated in FIG. 5A is supplied to the reference clock terminal 37. For example, the reference clock signal SMP is a rectangular wave having a frequency of 128 Hz, and a high level period and a low level period of the reference clock signal SMP are equal to each other. The reference clock signal SMP is supplied to the inverter 31. As illustrated in FIG. 5B, an inverted signal of the reference clock signal SMP is output from the inverter 31. The output signal of the inverter 31 is supplied to one input terminal of the NAND gate 34.

In addition, the output signal of the inverter 31 is supplied to the other input terminal of the NAND gate 34 via the inverter 32. The output signal of the inverter 32 charges and discharges the capacitor 33. In this manner, a signal having a waveform as illustrated in FIG. 5C is output from the inverter 32. The output signal of the inverter 32 is supplied to the NAND gate 34.

The output signal of the inverter 31 as illustrated in FIG. 5B and the output signal of the inverter 32 as illustrated in FIG. 5C are input to the NAND gate 34. In this manner, a pulse signal having a predetermined cycle and a predetermined pulse width is output from the NAND gate 34 as illustrated in FIG. 5D.

The output signal of the NAND gate 34 is supplied to one input terminal of the NAND gate 36. The check signal R_CHECKX is supplied from the check signal input terminal 35 to the other input terminal of the NAND gate 36. As illustrated in FIG. 5E, the check signal R_CHECKX is normally in a high level. As illustrated in FIG. 5F, while the check signal R_CHECKX is in the high level, an inverted signal of the output signal (FIG. 5D) of the NAND gate 34 is output from the NAND gate 36. As the one-shot pulse signal OSP, the output signal of the NAND gate 36 is supplied to the gate of the N-channel MOS transistor 21 and the P-channel MOS transistor 22.

As illustrated in FIG. 5F, the one-shot pulse signal OSP becomes a pulse signal having a predetermined width. That is, in this example, the one-shot pulse signal OSP is in a high level in synchronization with falling of the reference clock signal SMP having the frequency of 128 Hz, and the pulse width in the high level is 100 n seconds. The pulse width of 100 n seconds is very short compared to the cycle.

Next, an operation according to the present embodiment will be described. In FIG. 3, when the crown 104 (FIG. 1) is pressed, the crown switch 11 is turned off. When the crown switch 11 is turned off, one end of the signal line 12 is opened. At this time, the gate of the N-channel MOS transistor 16 is the reference potential Vdd. Accordingly, the N-channel MOS transistor 16 is turned on. Here, if the one-shot pulse signal OSP is in a high level, the N-channel MOS transistor 21 is turned on, the signal line 12 is connected to the power source Vss via the N-channel MOS transistor 16 and the N-channel MOS transistor 21, and the signal line 12 is pulled down to a low level.

At the time of initial setting, the system reset signal SRX output from the system reset terminal 18 is in a low level. If the system reset signal SRX is in the low level, the output signal PD of the NAND gate 19 is in a high level, the N-channel MOS transistor 17 is turned on, and the P-channel MOS transistor 23 is turned off. If the N-channel MOS transistor 17 is turned on, the N-channel MOS transistor 17 functions as the pull-down resistor, and the signal line 12 is pulled down to a low level.

In this way, at the time of initial setting, the signal line 12 is pulled down to the low level by the N-channel MOS transistor 16 and the N-channel MOS transistor 17. In this manner, the crown switch detection signal K1IN output from the crown switch detection terminal 15 is in a low level.

At the time of initial setting, the output signal PD of the NAND gate 19 is in a high level, and the P-channel MOS transistor 23 is turned off. Therefore, a route extending from the signal line 12 to the reference potential Vdd via the P-channel MOS transistor 22 and the P-channel MOS transistor 23 is turned off.

At the time of the normal operation, the system reset signal SRX output from the system reset terminal 18 is in a high level. In addition, the crown switch 11 is turned off. At the time of the normal operation, the N-channel MOS transistor 16 is turned on. If the N-channel MOS transistor 21 is turned on by the one-shot pulse signal OSP, the signal line 12 is connected to the power source Vss via the N-channel MOS transistor 16 and the N-channel MOS transistor 21, and the signal line 12 is pulled down to a low level.

If the signal line 12 is in the low level, the input signal of the NAND gate 19 is in a low level. Since the input signal of the NAND gate 19 is in the low level and the system reset signal SRX is in the high level, the output signal PD of the NAND gate 19 is in a high level, the N-channel MOS transistor 17 is turned on, and the P-channel MOS transistor 23 is turned off. If the N-channel MOS transistor 17 is turned on, the N-channel MOS transistor 17 functions as the pull-down resistor, and the signal line 12 is pulled down to a low level.

In this way, at the time of normal operation, the signal line 12 is pulled down to the low level by the N-channel MOS transistor 16 and the N-channel MOS transistor 17. The crown switch detection signal K1IN output from the crown switch detection terminal 15 is in a low level.

At the time of normal operation, the output signal PD of the NAND gate 19 is in a high level, and the P-channel MOS transistor 23 is turned off. Therefore, the route extending from the signal line 12 to the reference potential Vdd via the P-channel MOS transistor 22 and the P-channel MOS transistor 23 is turned off.

If the crown 104 is pulled out while the system is operated, the crown switch 11 is turned on. If the crown switch 11 is turned on, one end of the signal line 12 is connected to the reference potential Vdd via the crown switch 11, and the signal line 12 is in a high level.

If the signal line 12 is in a high level, the output of the inverter 14 is in a high level, and the crown switch detection signal K1IN output from the crown switch detection terminal 15 is in a high level. In addition, while the system is operated, the system reset signal SRX is in a high level. Therefore, the output signal PD of the NAND gate 19 is in a low level. If the output signal PD of the NAND gate 19 is in the low level, the N-channel MOS transistor 17 is turned off, and the P-channel MOS transistor 23 is turned on. Since the N-channel MOS transistor 17 is turned off, the N-channel MOS transistor 17 no longer functions as the pull-down resistor.

Furthermore, in the present embodiment, the N-channel MOS transistor 21 is disposed between the N-channel MOS transistor 16 and the power source Vss. The N-channel MOS transistor 21 is turned on or turned off by the one-shot pulse signal OSP. The currents flow in the N-channel MOS transistor 16 during a period while the one-shot pulse signal OSP is in a high level and the N-channel MOS transistor 21 is turned on. As illustrated in FIG. 5F, the period while the one-shot pulse signal OSP is in the high level is a very short period of 100 ns. Therefore, a small amount of the currents flows via the N-channel MOS transistor 16.

In addition, at this time, the P-channel MOS transistor 23 is turned on. The P-channel MOS transistor 22 is operated with the N-channel MOS transistor 21 in a complementary manner by the one-shot pulse signal OSP. In this manner, while the one-shot pulse signal OSP is in a low level, the signal line 12 is allowed to maintain a high level by the route extending from the signal line 12 to the reference potential Vdd via the P-channel MOS transistor 22 and the P-channel MOS transistor 23.

If the crown 104 is pressed again, the crown switch 11 is switched from a turned-on state to a turned-off state. If the crown switch 11 is switched from the turned-on state to the turned-off state, one end of the signal line 12 is opened. At this time, the N-channel MOS transistor 16 is turned on. If the N-channel MOS transistor 21 is turned on by the one-shot pulse signal OSP, the currents flow from the signal line 12 via the N-channel MOS transistor 16 and the N-channel MOS transistor 21, and the signal line 12 is pulled down to a low level. In this manner, the output signal of the inverter 14 is in a low level, and the crown switch detection signal K1IN output from the crown switch detection terminal 15 is in a low level.

If the output signal of the inverter 14 is in the low level, the output signal PD of the NAND gate 19 is in a high level, the N-channel MOS transistor 17 is turned on, and the P-channel MOS transistor 23 is turned off. If the N-channel MOS transistor 17 is turned on, the N-channel MOS transistor 17 functions as the pull-down resistor, and the signal line 12 is pulled down to a low level.

As illustrated in FIG. 5G, when the crown switch 11 is turned off, if the one-shot pulse signal OSP is in a low level, the P-channel MOS transistor 22 and the P-channel MOS transistor 23 are turned on, and the N-channel MOS transistor 21 is turned off. Therefore, the signal line 12 is allowed to maintain a high level by the route extending from the signal line 12 to the reference potential Vdd via the P-channel MOS transistor 22 and the P-channel MOS transistor 23. As illustrated in FIG. 5H, the crown switch detection signal K1IN is allowed to maintain a high level. However, if the one-shot pulse signal OSP is changed from a low level to a high level, the P-channel MOS transistor 22 is turned off, the N-channel MOS transistor 21 is turned on, and the signal line 12 is pulled down to a low level. If the signal line 12 is pulled down to the low level, the output signal PD of the NAND gate 19 is in a high level, the P-channel MOS transistor 23 is turned off, and the N-channel MOS transistor 17 is turned on. Therefore, the signal line 12 is pulled down to the low level. As illustrated in FIG. 5H, the crown switch detection signal K1IN is in a low level.

In the present embodiment, the one-shot pulse signal OSP is supplied to the gate of the N-channel MOS transistor 21, the N-channel MOS transistor 21 is turned on and turned off, and the N-channel MOS transistor 16 is intermittently driven. In this manner, current consumption is reduced when the crown switch 11 is turned on. For example, the present embodiment employs the one-shot pulse signal OSP in which the frequency is 128 Hz and the pulse width is 100 n seconds as illustrated in FIG. 5F. Accordingly, an average current during pull-down can be minimized to 1 nA or smaller, for example.

Here, if the pulse width (period of a high level) of the one-shot pulse signal OSP illustrated in FIG. 5F is shortened, the more advantageous effect of reducing the currents is obtained. However, if the pulse width of the one-shot pulse signal OSP is shortened, a function as the pull-down resistor becomes poor.

As illustrated in FIG. 4, in the one-shot pulse signal generation circuit 30 according to the present embodiment, the N-channel MOS transistor 54 of the inverter 32 charges and discharges the capacitor 33, and forms a signal having the waveform as illustrated in FIG. 5C, thereby generating the one-shot pulse signal OSP. The pulse width of the one-shot pulse signal OSP is determined by capacitance of the capacitor 33 and driving ability of the N-channel MOS transistor 54.

That is, if the capacitance of the capacitor 33 increases, a change is delayed in a falling edge of the signal illustrated in FIG. 5C, and the pulse width of the one-shot pulse signal OSP is lengthened. If the capacitance of the capacitor 33 decreases, a change is quickened in the falling edge of the signal illustrated in FIG. 5C, and the pulse width of the one-shot pulse signal OSP is shortened.

In addition, if the driving ability of the N-channel MOS transistor 54 is small, a time required for charging and discharging the capacity of the capacitor 33 is lengthened, and the pulse width of the one-shot pulse signal OSP is lengthened. If the driving ability of the N-channel MOS transistor 54 is great, the time required for charging and discharging the capacity of the capacitor 33 is shortened, and the pulse width of the one-shot pulse signal OSP is shortened.

In FIG. 3, the N-channel MOS transistor 16 functioning as the pull-down resistor is an N-channel MOS transistor similar to the N-channel MOS transistor 54 of the one-shot pulse signal generation circuit 30. Therefore, characteristics on an integrated circuit show a similar tendency. For this reason, according to the present embodiment, a change in the pulse width of the one-shot pulse signal generation circuit 30 and a change in the pull-down ability of the N-channel MOS transistor 16 work in a complementary manner. Accordingly, variations in the pull-down ability are minimized, thereby stabilizing the pull-down ability.

That is, in a case where the driving ability of the N-channel MOS transistor 54 of the one-shot pulse signal generation circuit 30 is great, the pulse width of the one-shot pulse signal OSP is shortened. If the pulse width of the one-shot pulse signal OSP is shortened, the pull-down ability of the N-channel MOS transistor 16 tends to become poor. However, each driving ability of the N-channel MOS transistor 54 and the N-channel MOS transistor 16 shows a similar tendency. That is, if the driving ability of the N-channel MOS transistor 54 increases due to variations in the manufacturing process, the driving ability of the N-channel MOS transistor 16 also increases. In addition, if the driving ability of the N-channel MOS transistor 54 increases due to an influence such as a temperature change, the driving ability of the N-channel MOS transistor 16 also increases. For this reason, even if the driving ability of the N-channel MOS transistor 54 increases and the pulse width of the one-shot pulse signal OSP is shortened, the poor pull-down ability caused by the shortened pulse width of the one-shot pulse signal OSP is offset by the increased pull-down ability of the N-channel MOS transistor 16. Therefore, the pull-down ability does not vary greatly.

In addition, in a case where the driving ability of the N-channel MOS transistor 54 of the one-shot pulse signal generation circuit 30 is small, the pulse width of the one-shot pulse signal OSP is lengthened. If the pulse width of the one-shot pulse signal OSP is lengthened, the N-channel MOS transistor 16 tends to increase the currents. However, each driving ability of the N-channel MOS transistor 54 and the N-channel MOS transistor 16 shows a similar tendency. Therefore, if the driving ability of the N-channel MOS transistor 54 decreases, the driving ability of the N-channel MOS transistor 16 also decreases, thereby reducing the currents flowing in the N-channel MOS transistor 16. For this reason, the increased currents caused by the lengthened pulse width of the one-shot pulse signal OSP are offset by the reduced currents caused by the decreased driving ability of the N-channel MOS transistor 16. Therefore, the current consumption does not vary greatly.

In addition, in the one-shot pulse signal generation circuit 30 according to the present embodiment, the capacitor 33 employs capacitance using a gate oxide film. Therefore, the capacitance of the capacitor 33 and the driving ability of the N-channel MOS transistor 54 work in a complementary manner, thereby minimizing variations in the pulse width of the one-shot pulse signal OSP.

That is, the capacitor 33 of the one-shot pulse signal generation circuit 30 employs the capacitance using the gate oxide film. Accordingly, if the gate oxide film is thickened, the capacitance decreases. If the capacitance of the capacitor 33 decreases, the pulse width of the one-shot pulse signal OSP tends to be shortened. However, if the gate oxide film is thickened in the capacitor 33 of the one-shot pulse signal generation circuit 30, in response to the thickened gate oxide film, the gate oxide film of the N-channel MOS transistor 54 configuring the inverter 32 is also thickened. If the gate oxide film of the N-channel MOS transistor 54 is thickened, the driving ability of the N-channel MOS transistor 54 becomes poor. Therefore, a time required for charging and discharging the capacitor 33 is lengthened, and the pulse width of the one-shot pulse signal OSP tends to be lengthened. In this way, the gate oxide film is thickened, and the capacitance of the capacitor 33 decreases. Accordingly, even if the pulse width of the one-shot pulse signal OSP is shortened, the shortened pulse width is offset by the poor driving ability of the N-channel MOS transistor 54, thereby minimizing variations in the pulse width of the one-shot pulse signal OSP.

Furthermore, a depletion layer is prevented from spreading by arranging a highly impure region under the gate oxide film, thereby reducing variations in a capacitance value with respect to a gate voltage. Accordingly, it is possible to further minimize the variations in the pulse width of the one-shot pulse signal OSP.

As described above, the electronic timepiece 100 according to the present embodiment includes the crown switch 11 serving as the first switch connected to the signal line 12, the N-channel MOS transistor 21 serving as the second switch, and the one-shot pulse signal generation circuit 30. The crown switch 11 is inserted into the signal line 12, and one end of the N-channel MOS transistor 21 is connected to the signal line 12 on the rear stage of the crown switch 11. The other end of the N-channel MOS transistor 21 is connected to the power source Vss. The one-shot pulse signal generation circuit 30 generates the one-shot pulse signal OSP by using the reference clock signal SMP, and the N-channel MOS transistor 21 is controlled by the one-shot pulse signal OSP.

According to this configuration, when the crown 104 is pulled out and the crown switch 11 is turned on, the currents flowing in the pull-down resistor can be considerably reduced. In this manner, in a case where the crown 104 is pulled out and the electronic timepiece 100 is displayed in a store, it is possible to prolong the battery life.

In addition, the electronic timepiece 100 according to the present embodiment includes the oscillator circuit 2, and the clocking unit 6 that clocks a time, based on the frequency in which the frequency obtainable from the oscillator circuit 2 is divided. The reference clock signal SMP is configured to include the frequency in which the frequency obtainable from the oscillator circuit 2 is divided. The first switch (crown switch 11) is a switch for operating the crown 104 so as to select a connection state and a disconnection state.

In addition, in the electronic timepiece 100 according to the present embodiment, the one-shot pulse signal generation circuit 30 includes the first inverter 31, the second inverter 32, the capacitor 33, and the NAND gate 34. The reference clock signal SMP is input to the input terminal of the first inverter 31. The input terminal of the second inverter 32 and one input terminal of the NAND gate 34 is connected to the output terminal of the first inverter 31. One end of the capacitor 33 and the other input terminal of the NAND gate 34 are connected to the output terminal of the second inverter 32. The other end of the capacitor 33 is connected to the reference potential. Based on an output signal of the NAND gate 34, the one-shot pulse signal generation circuit 30 generates a high level signal having a period shorter than a period while the reference clock signal SMP is in a high level.

According to this configuration, a pulse signal having a short period of a high level is generated without using a high frequency signal. In this manner, the pull-down resistor can be intermittently driven, and power consumption can be reduced. That is, the pulse signal having a short period is generated by using the frequency (reference clock signal SMP) of approximately 128 Hz, for example, which is generated from the oscillation frequency of 32 kHz (32,768 Hz) by the quartz resonator included in the oscillator circuit 2 of the electronic timepiece 100, and the pull-down resistor can be intermittently driven. Accordingly, without requiring the high frequency dedicated to the intermittent driving, reduced power consumption can be efficiently realized. That is, it is insufficient to simply divide the above-described oscillation frequency in order to generate the pulse having a short period of 100 ns as illustrated in FIG. 3F, for example. However, the crown switch detection circuit 1 configured according to the present invention is employed. Accordingly, while a circuit scale is reasonably minimized, the pull-down resistor can be intermittently driven by using the above-described oscillation frequency and the pulse having the very short period. In this regard, the above-described reference clock signal SMP can employ the frequency generated from the oscillation frequency of 32 kHz which is also used for the clocking mechanism functioning as a timepiece base. Therefore, this configuration can be realized as a unique function of the electronic timepiece 100.

In addition, in the electronic timepiece 100 according to the present embodiment, the capacitor 33 is formed by the capacitance using the gate oxide film. The N-channel MOS transistor 54 configuring the second inverter 32 delays falling of the reference clock signal SMP by charging and discharging the capacitor 33. The pulse width during a period while the one-shot pulse signal OSP is in a high level is determined by the capacitance of the capacitor 33 and the driving ability of the N-channel MOS transistor 54 configuring the second inverter 32.

According to this configuration, the driving ability of the N-channel MOS transistor 54 configuring the second inverter 32 and the capacitance of the capacitor 33 are offset by each other. Accordingly, it is possible to minimize variations in the pulse width. In addition, a change in the capacitor 33 and a change in the driving ability of the N-channel MOS transistor 16 functioning as the pull-down resistor are offset by each other. Accordingly, variations in the pull-down ability are minimized, thereby stabilizing the pull-down ability or current consumption.

In addition, in the electronic timepiece 100 according to the present embodiment, the N-channel MOS transistor 16 serving as the second switch is used as the first pull-down resistor, thereby controlling the function of the N-channel MOS transistor 16 in accordance with the one-shot pulse signal OSP.

According to this configuration, the first pull-down resistor can be intermittently driven in such a way that the N-channel MOS transistor 16 functioning as the second switch is used as the first pull-down resistor.

In addition, in the electronic timepiece 100 according to the present embodiment, the N-channel MOS transistor 16 functioning as the first pull-down resistor is inserted between the signal line 12 and the N-channel MOS transistor 21 functioning as the second switch, thereby controlling the function of the first pull-down resistor in accordance with the one-shot pulse signal OSP.

According to this configuration, the N-channel MOS transistor 16 functioning as the first pull-down resistor is inserted between the signal line 12 and the N-channel MOS transistor 21 functioning as the second switch. Accordingly, the first pull-down resistor can be intermittently driven.

In addition, in the electronic timepiece 100 according to the present embodiment, the N-channel MOS transistor 17 functioning as the second pull-down resistor is inserted between the signal line 12 and the power source Vss, thereby controlling the function of the N-channel MOS transistor 17 in accordance with the output level and the system reset signal SRX of the signal line 12.

According to this configuration, while the crown switch 11 is turned off, the signal line 12 is pulled down by the N-channel MOS transistor 17 functioning as the second pull-down resistor. In this manner, the electronic timepiece 100 can be hardly affected by noise.

In addition, in the electronic timepiece 100 according to the present embodiment, the P-channel MOS transistor 22 serving as the third switch for connecting the signal line 12 and the reference potential Vdd is inserted between the signal line 12 and the reference potential Vdd, thereby operating the P-channel MOS transistor 22 with the N-channel MOS transistor 21 in a complementary manner.

According to this configuration, while the crown switch 11 is turned on, a signal level of the signal line 12 can be maintained in a high level by the P-channel MOS transistor 22 functioning as the third switch.

Modification Example of First Embodiment

Figure 6:
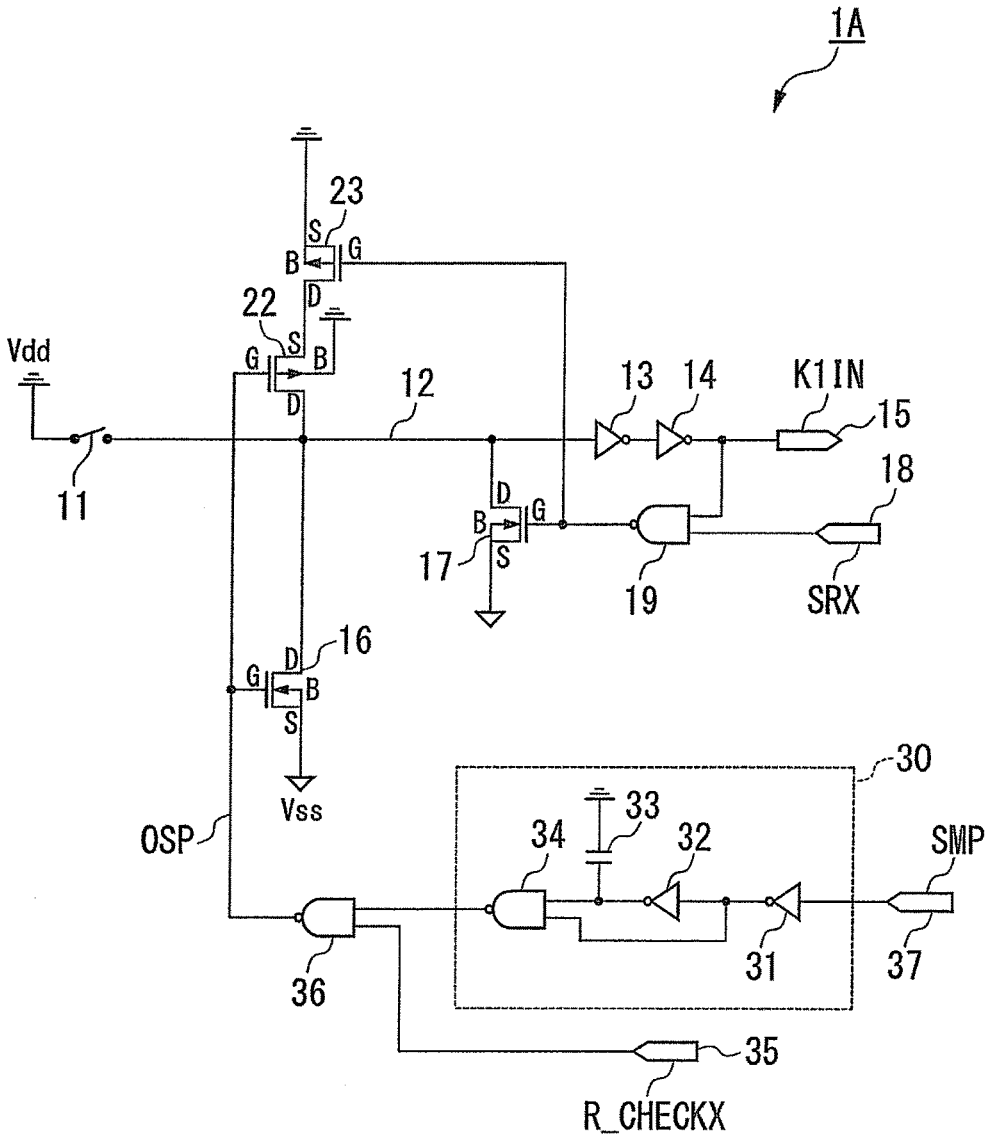
FIG. 6 is a circuit diagram illustrating a modification example of the crown switch detection circuit in the timepiece device according to the first embodiment.

FIG. 6 is a circuit diagram illustrating a modification example of a crown switch detection circuit 1A in the timepiece device according to the present embodiment. In FIG. 6, the same reference numerals will be given to the same elements as the crown switch detection circuit 1 in FIG. 3, and description thereof will be omitted. The configuration of the electronic timepiece 100 in the modification example is a configuration in which the crown switch detection circuit 1 in FIG. 2 is replaced with the crown switch detection circuit 1A.

In the above-described crown switch detection circuit 1 illustrated in FIG. 3, the N-channel MOS transistor 21 is inserted between the N-channel MOS transistor 16 functioning as the pull-down resistor and the power source Vss. The N-channel MOS transistor 21 is turned on and turned off by the one-shot pulse signal OSP, thereby intermittently driving the N-channel MOS transistor 16. In this manner, according to the configuration illustrated in FIG. 3, the N-channel MOS transistor 16 functioning as the pull-down resistor is separated from the N-channel MOS transistor 21 functioning as the switching element.

In contrast, according to the modification example illustrated in FIG. 6, the N-channel MOS transistor 16 functioning as the pull-down resistor is turned on and turned off by the one-shot pulse signal OSP. The respective functions of the N-channel MOS transistor 16 and the N-channel MOS transistor 21 according to the configuration in FIG. 3 are performed by one N-channel MOS transistor 16. Other configurations are the same as those illustrated in FIG. 3. In the N-channel MOS transistor 16, the drain is connected to the signal line 12, the source and the body are connected to the power source Vss, and the one-shot pulse signal OSP is supplied to the gate.

The above-described modification example of the first embodiment can obtain an advantageous effect which is the same as that according to the first embodiment.

Second Embodiment

Next, a second embodiment will be described. The configuration of the electronic timepiece 100 according to the present embodiment is a configuration in which the crown switch detection circuit 1 in FIG. 2 is replaced with a crown switch detection circuit 1B.

Figure 7:
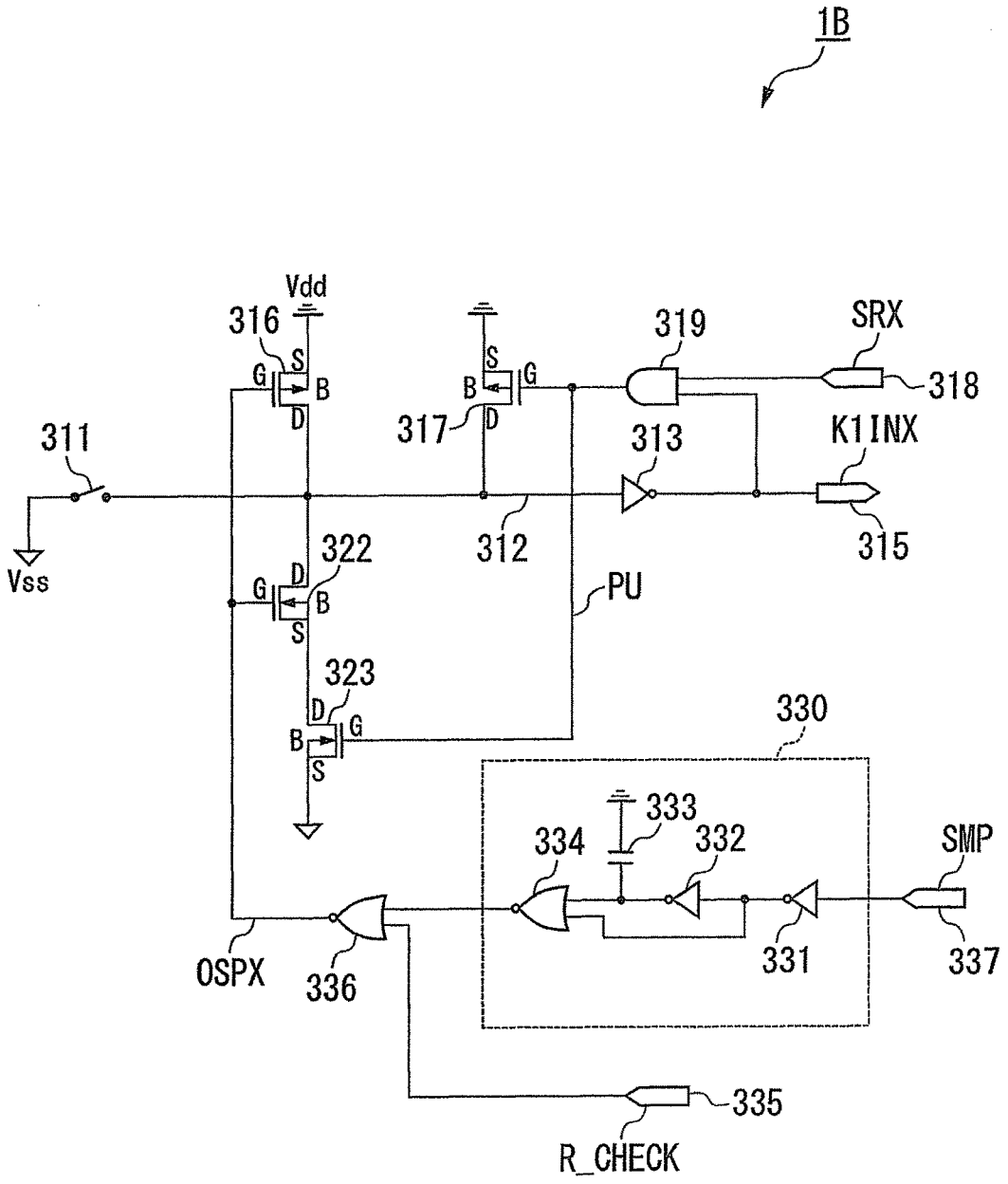
FIG. 7 is a circuit diagram illustrating a configuration of a crown switch detection circuit in a timepiece device according to a second embodiment.

FIG. 7 is a circuit diagram illustrating a configuration of the crown switch detection circuit 1B in the timepiece device according to the present embodiment. In a circuit illustrated in FIG. 7, the reference potential Vdd has a higher voltage than the power source Vss. For example, the power source Vss is −1.55 V.

In FIG. 7, a crown switch 311 is inserted between one end of a signal line 312 and the power source Vss. The other end of the signal line 312 is connected to a crown switch detection terminal 315 via an inverter 313. A crown switch detection signal K1INX is output from the crown switch detection terminal 315. The crown switch detection signal K1INX is a signal for detecting a state where the crown switch 311 is turned on and turned off.

A P-channel MOS transistor 316 and a P-channel MOS transistor 317 are inserted between the signal line 312 and the reference potential Vdd. The P-channel MOS transistor 316 and the P-channel MOS transistor 317 function as a pull-up resistor. In the P-channel MOS transistor 316, the drain is connected to the signal line 312, and the source and the body are connected to the reference potential Vdd. A one-shot pulse signal OSPX is supplied from a NOR gate 336 to the gate of the P-channel MOS transistor 316. In the P-channel MOS transistor 317, the drain is connected to the signal line 312, and the source and the body are connected to the reference potential Vdd. An output signal PU of an AND gate 319 is supplied to the gate of the P-channel MOS transistor 317.

In addition, an N-channel MOS transistor 322 and an N-channel MOS transistor 323 are inserted between the signal line 312 and the power source Vss. In the N-channel MOS transistor 322, the drain is connected to the signal line 312, and the source and the body are connected to the drain of the N-channel MOS transistor 323. The one-shot pulse signal OSPX is supplied from the NOR gate 336 to the gate of the N-channel MOS transistor 322. In the N-channel MOS transistor 323, the source and the body are connected to the power source Vss. The output signal PU of the AND gate 319 is supplied to the gate of the N-channel MOS transistor 323.

The output signal of the inverter 313 is supplied to one input terminal of the AND gate 319. The system reset signal SRX is supplied from a system reset terminal 318 to the other input terminal of the AND gate 319. The system reset signal SRX is a signal for performing power-on reset. The system reset signal SRX is in a high level while the system is operated, and is in a low level when the power-on reset is performed. The input terminal of the inverter 313 is connected to the signal line 312.

A one-shot pulse signal generation circuit 330 is configured to include an inverter 331, an inverter 332, a capacitor 333, and a NOR gate 334.

In the inverter 331, the reference clock signal SMP is input to the input terminal, and the input terminal of the inverter 332 and one input terminal of the NOR gate 334 are connected to the output terminal. In the inverter 332, one end of the capacitor 333 and the other input terminal of the NOR gate 334 are connected to the output terminal. The other end of the capacitor 333 is connected to the reference potential.

The reference clock signal SMP is supplied from a reference clock terminal 337 to the one-shot pulse signal generation circuit 330. The output signal is supplied from the NOR gate 334 of the one-shot pulse signal generation circuit 330 to one input terminal of the NOR gate 336. A check signal R_CHECK is supplied from a check signal input terminal 335 to the other input terminal of the NOR gate 336. The check signal R_CHECK is a signal for checking the pull-up resistor, and is normally in a low level. When the pull-up resistor is checked, the check signal R_CHECK is in a high level.

The one-shot pulse signal OSPX is output from the NOR gate 336. The one-shot pulse signal OSPX is supplied to the gate of the P-channel MOS transistor 316 and the gate of the N-channel MOS transistor 322.

Figure 8:
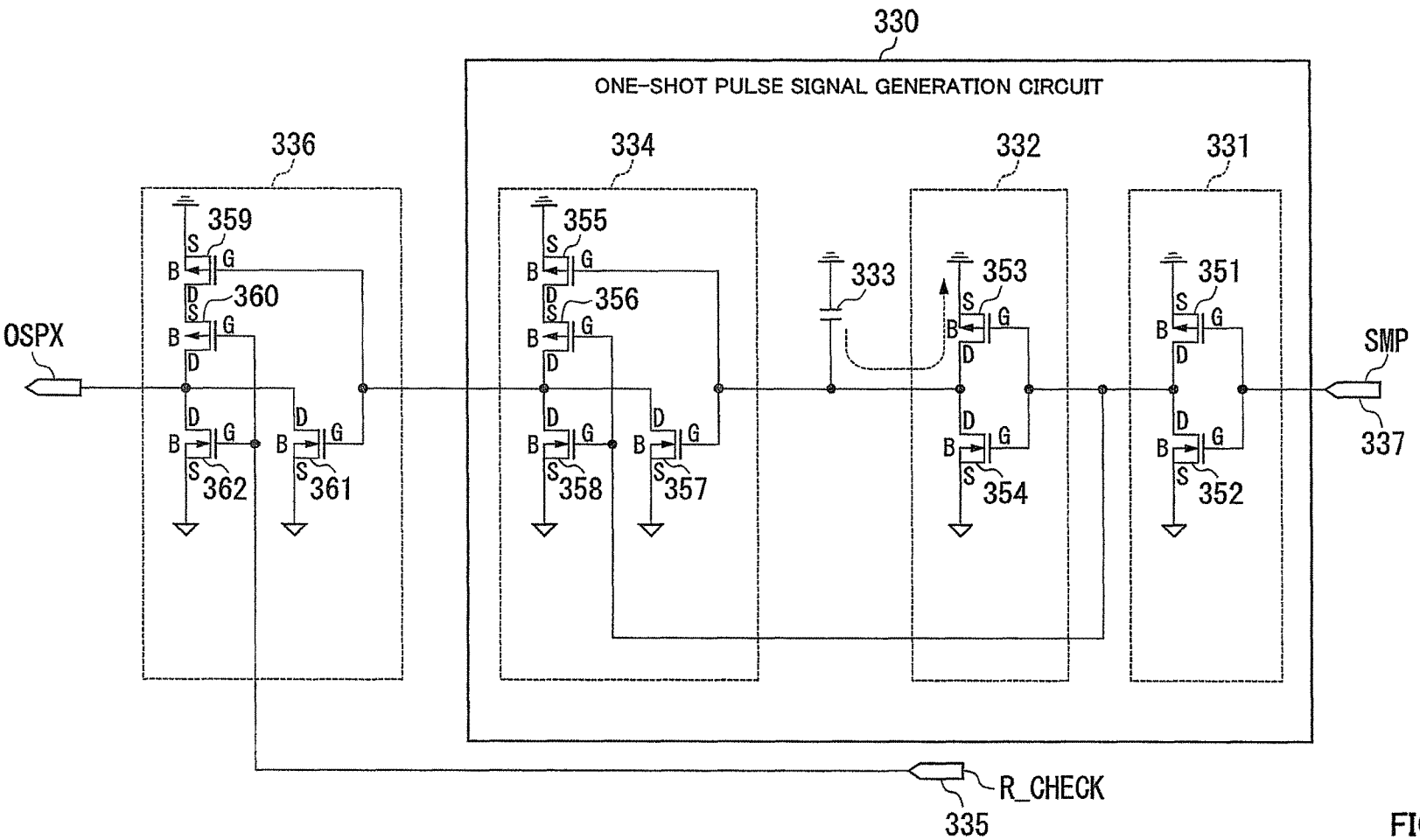
FIG. 8 is a circuit diagram illustrating an example of a one-shot pulse signal generation circuit according to the second embodiment.

FIG. 8 is a circuit diagram illustrating an example of the one-shot pulse signal generation circuit 330. As illustrated in FIG. 8, the inverter 331 is configured to include a CMOS inverter having a P-channel MOS transistor 351 and an N-channel MOS transistor 352. A configuration of the inverter 331 is a configuration in which the P-channel MOS transistor 51 of the inverter 31 (FIG. 4) is replaced with the P-channel MOS transistor 351 and the N-channel MOS transistor 52 is replaced with the N-channel MOS transistor 352.

In addition, the inverter 332 is configured to include a CMOS inverter having a P-channel MOS transistor 353 and an N-channel MOS transistor 354. A configuration of the inverter 332 is a configuration in which the P-channel MOS transistor 53 of the inverter 32 (FIG. 4) is replaced with the P-channel MOS transistor 353 and the N-channel MOS transistor 54 is replaced with the N-channel MOS transistor 354. The capacitor 333 is formed by capacitance using the gate oxide film.

The NOR gate 334 is configured to include a NOR gate of CMOS having P-channel MOS transistors 355 and 356 and N-channel MOS transistors 357 and 358. An intersection point among the drain of the P-channel MOS transistor 353, the drain of the N-channel MOS transistor 354, and one end of the capacitor 333 is connected to the gate of the P-channel MOS transistor 355 and the gate of the N-channel MOS transistor 357. In the P-channel MOS transistor 355, the drain is connected to the source of the P-channel MOS transistor 356, and the source and the body are connected to the reference potential. In the P-channel MOS transistor 356, the drain is connected to the drain of the N-channel MOS transistor 357 and the drain of the N-channel MOS transistor 358, and the gate is connected to the drain of the P-channel MOS transistor 351, the drain of the N-channel MOS transistor 352, and the gate of the N-channel MOS transistor 358. The source and the body of the N-channel MOS transistor 357 are connected to the power source Vss. The source and the body of the N-channel MOS transistor 358 are connected to the power source Vss.

The NOR gate 336 is configured to include a NOR gate of CMOS having P-channel MOS transistor 359 and 360 and N-channel MOS transistors 361 and 362. An intersection point among the drain of the P-channel MOS transistor 356, the drain of the N-channel MOS transistor 357, and the drain of the N-channel MOS transistor 358 is connected to the gate of the P-channel MOS transistor 359 and the gate of the N-channel MOS transistor 361. In the P-channel MOS transistor 359, the drain is connected to the source of the P-channel MOS transistor 360, and the source and the body are connected to the reference potential. In the P-channel MOS transistor 360, the drain is connected to the drain of the N-channel MOS transistor 361 and the drain of the N-channel MOS transistor 362, and the gate is connected to the check signal input terminal 335. The source and the body of the N-channel MOS transistor 361 are connected to the power source Vss. The source and the body of the N-channel MOS transistor 362 are connected to the power source Vss. An intersection point among the drain of the P-channel MOS transistor 360, the drain of the N-channel MOS transistor 361, and the drain of the N-channel MOS transistor 362 is an output of the NOR gate 336, and is the one-shot pulse signal OSPX.

Figure 9:
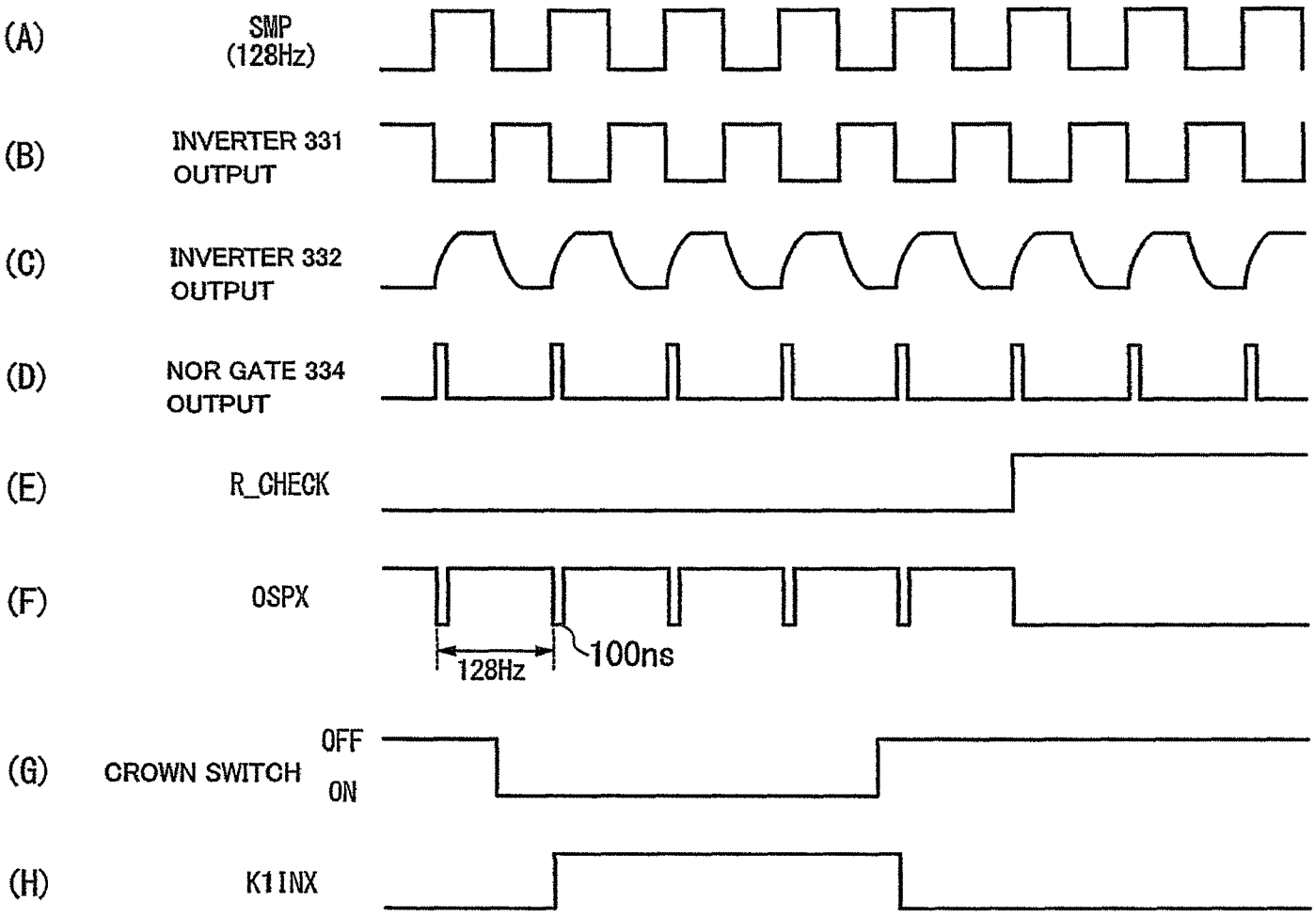
FIGS. 9A to 9H are waveform charts illustrating an operation of the one-shot pulse signal generation circuit according to the second embodiment.
Figure 10:
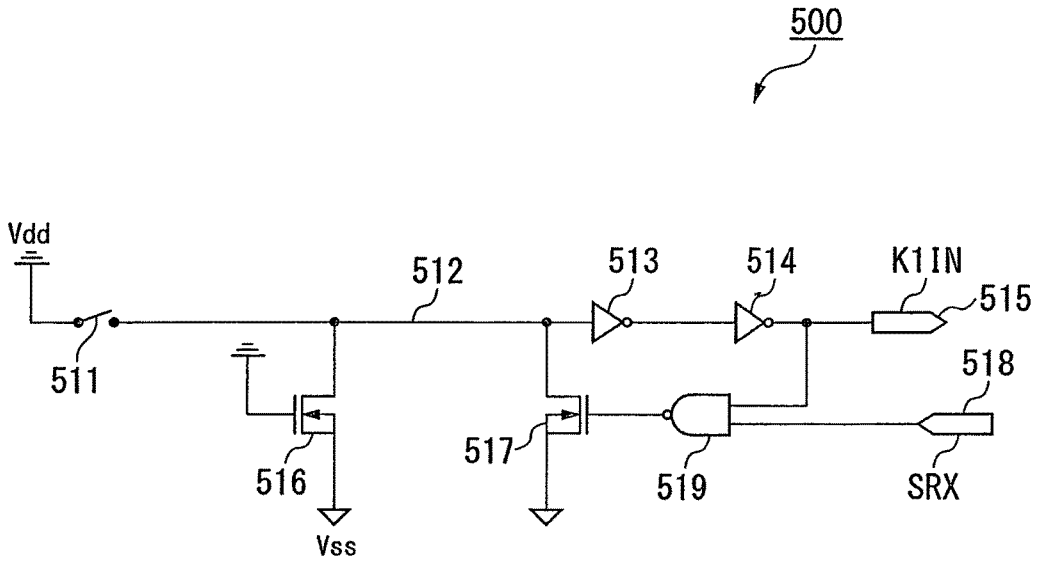
FIG.10 PRIOR ART
FIG. 10 is a circuit diagram illustrating a configuration of a crown switch detection circuit in a timepiece device in the related art.

FIGS. 9A to 9H are waveform charts illustrating an operation of the one-shot pulse signal generation circuit 330 according to the present embodiment. The reference clock signal SMP as illustrated in FIG. 9A is supplied to the reference clock terminal 337. For example, the reference clock signal SMP is a rectangular wave having a frequency of 128 Hz, and a high level period and a low level period of the reference clock signal SMP are equal to each other. The reference clock signal SMP is supplied to the inverter 331. As illustrated in FIG. 9B, an inverted signal of the reference clock signal SMP is output from the inverter 331. The output signal of the inverter 331 is supplied to one input terminal of the NOR gate 334.

In addition, the output signal of the inverter 331 is supplied to one input terminal of the NOR gate 334 via the inverter 332. The capacitor 333 is formed between the inverter 332 and the NOR gate 334. The output signal of the inverter 332 charges and discharges the capacitor 333. In this manner, a signal having a waveform as illustrated in FIG. 9C is output from the inverter 332. The output signal of the inverter 332 is supplied to the other input terminal of the NOR gate 334.

The output signal of the inverter 331 as illustrated in FIG. 9B and the output signal of the inverter 332 which has a waveform as illustrated in FIG. 9C are input to the NOR gate 334. In this manner, a pulse signal having a predetermined cycle and a predetermined pulse width is output from the NOR gate 334 as illustrated in FIG. 9D.

The output signal of the NOR gate 334 is supplied to one input terminal of the NOR gate 336. The check signal R_CHECK is supplied from the check signal input terminal to the other input terminal of the NOR gate 336. As illustrated in FIG. 9E, the check signal R_CHECK is normally in a low level. As illustrated in FIG. 9F, while the check signal R_CHECK is in the low level, an inverted signal of the output signal (FIG. 9D) of the NOR gate 334 is output from the NOR gate 336. As the one-shot pulse signal OSPX, the output signal of the NOR gate 336 is supplied to the gate of the P-channel MOS transistor 316 and the N-channel MOS transistor 322.

As illustrated in FIG. 9F, the one-shot pulse signal OSPX becomes a pulse signal having a predetermined width. That is, in this example, the one-shot pulse signal OSPX is in a low level on a cycle in synchronization with rising of the reference clock signal SMP having the frequency of 128 Hz, and the pulse width in the low level is 100 n seconds. The pulse width of 100 n seconds is very short compared to the cycle.

Next, an operation according to the present embodiment will be described. When the crown 104 is pressed, the crown switch 311 is turned off. When the crown switch 311 is turned off, one end of the signal line 312 is opened. Here, if the one-shot pulse signal OSPX is in a low level, the P-channel MOS transistor 316 is turned on, the signal line 312 is connected to the power source Vdd via the P-channel MOS transistor 316, and the signal line 312 is pulled up to a high level. If the signal line 312 is in the high level, the output signal of the inverter 313 is in a low level.

At the time of initial setting, the system reset signal SRX output from the system reset terminal 318 is in a low level. The output signal PU of the AND gate 319 is in a low level, the P-channel MOS transistor 317 is turned on, and the N-channel MOS transistor 323 is turned off. If the P-channel MOS transistor 317 is turned on, the P-channel MOS transistor 317 functions as the pull-up resistor, and the signal line 312 is pulled up to a high level.

In this way, at the time of initial setting, the signal line 312 is pulled up to the high level by the P-channel MOS transistor 317 and the P-channel MOS transistor 316. In this manner, the crown switch detection signal K1INX is in a low level.

At the time of initial setting, the output signal PU of the AND gate 319 is in a low level, and the N-channel MOS transistor 323 is turned off. Therefore, a route extending from the signal line 312 to the reference potential Vss via the N-channel MOS transistor 322 and the N-channel MOS transistor 323 is turned off.

At the time of the normal operation, the system reset signal SRX output from the system reset terminal 318 is in a high level. In addition, the crown switch 311 is turned off. At the time of the normal operation, if the P-channel MOS transistor 316 is turned on by the one-shot pulse signal OSPX, the signal line 312 is connected to the power source Vdd via the P-channel MOS transistor 316, and the signal line 312 is pulled up to a high level. If the signal line 312 is pulled up to the high level, the output signal of the inverter 313 is in a low level. In this manner, the crown switch detection signal K1INX output from the crown switch detection terminal 315 is in a low level.

The output signal of the inverter 313 is in a low level, and the system reset signal SRX output from the system reset terminal 318 is in a high level. Accordingly, the output signal PU of the AND gate 319 is in a low level. If the output signal PU of the AND gate 319 is in the low level, the P-channel MOS transistor 317 is turned on, and the N-channel MOS transistor 323 is turned off. If the P-channel MOS transistor 317 is turned on, the P-channel MOS transistor 317 functions as the pull-up resistor, and the signal line 312 is pulled up to a high level.

In this way, at the time of normal operation, the signal line 312 is pulled up to the high level by the P-channel MOS transistor 317 and the P-channel MOS transistor 316.

At the time of normal operation, the output signal PU of the AND gate 319 is in a low level, and the N-channel MOS transistor 323 is turned off. Therefore, a route extending from the signal line 312 to the power source Vss via the N-channel MOS transistor 322 and the N-channel MOS transistor 323 is turned off.

If the crown 104 is pulled out while the system is operated, the crown switch 311 is turned on. If the crown switch 311 is turned on, one end of the signal line 312 is connected to the power source Vss via the crown switch 311, and the signal line 312 is in a low level.

If the signal line 312 is in the low level, the output of the inverter 313 is in a high level, and the crown switch detection signal K1INX output from the crown switch detection terminal 315 is in a high level. In addition, while the system is operated, the system reset signal SRX is in a high level. Therefore, the output signal PU of the AND gate 319 is in a high level, the P-channel MOS transistor 317 is turned off, and the N-channel MOS transistor 323 is turned on. If the P-channel MOS transistor 317 is turned off, the P-channel MOS transistor 317 no longer functions as the pull-up resistor.

At this time, if the P-channel MOS transistor 316 is turned on, currents flow via the P-channel MOS transistor 316. The P-channel MOS transistor 316 is turned on during only a period while the one-shot pulse signal OSPX is in a low level. As illustrated in FIG. 9F, the period while the one-shot pulse signal OSPX is in the low level is very short. Therefore, a small amount of the currents flows via the P-channel MOS transistor 316.

In addition, at this time, the N-channel MOS transistor 322 is operated with the P-channel MOS transistor 316 in a complementary manner by the one-shot pulse signal OSPX. In this manner, while the one-shot pulse signal OSPX is in a high level, the signal line 312 is connected to the route extending from the signal line 312 to the power source Vss via the N-channel MOS transistor 322 and the N-channel MOS transistor 323, and is allowed to maintain a low level.

If the crown 104 is pressed again, the crown switch 311 is switched from a turned-on state to a turned-off state. If the crown switch 311 is switched from the turned-on state to the turned-off state, one end of the signal line 312 is opened. At this time, if the one-shot pulse signal OSPX is in a low level and the P-channel MOS transistor 316 is turned on, the signal line 312 is connected via the P-channel MOS transistor 316, the signal line 312 is pulled up to a high level. In this manner, the output signal of the inverter 313 is in a low level, and the crown switch detection signal K1INX output from the crown switch detection terminal 315 is in a low level.

If the output signal of the inverter 313 is in the low level, the output signal PU of the AND gate 319 is in a low level, the P-channel MOS transistor 317 is turned on, and the N-channel MOS transistor 323 is turned off. If the P-channel MOS transistor 317 is turned on, the P-channel MOS transistor 317 functions as the pull-up resistor, and the signal line 312 is pulled up to a high level.

When the crown switch 311 is turned off, if the one-shot pulse signal OSPX is in a high level, the N-channel MOS transistor 322 and the N-channel MOS transistor 323 are turned on, and the P-channel MOS transistor 316 is turned off. Therefore, the signal line 312 is allowed to maintain a low level by the route extending from the signal line 312 to the power source Vss via the N-channel MOS transistor 322 and the N-channel MOS transistor 323. As illustrated in FIG. 9H, the crown switch detection signal K1INX is allowed to maintain a high level. However, if the one-shot pulse signal OSPX is in a low level, the N-channel MOS transistor 322 is turned off, the P-channel MOS transistor 316 is turned on, and the signal line 312 is pulled up to a high level. If the signal line 312 is pulled up to the high level, the output signal PU of the AND gate 319 is in a low level, and the N-channel MOS transistor 323 is turned off. Therefore, as illustrated in FIG. 9H, the crown switch detection signal K1INX is in a low level.

In the present embodiment, the one-shot pulse signal OSPX is supplied to the gate of the P-channel MOS transistor 316, and the P-channel MOS transistor 316 is intermittently driven, thereby reducing current consumption when the crown switch 311 is turned on. Here, if the pulse width (period of a low level) of the one-shot pulse signal OSPX illustrated in FIG. 9F is shortened, an advantageous effect increases in reducing current consumption.

In addition, the P-channel MOS transistor 316 functioning as the pull-up resistor is the P-channel MOS resistor similar to the P-channel MOS transistor 353 of the one-shot pulse signal generation circuit 330. Therefore, characteristics on an integrated circuit show a similar tendency. For this reason, according to the present embodiment, similarly to the first embodiment, a change in the pulse width of the one-shot pulse signal generation circuit 330 and a change in the pull-up ability of the P-channel MOS transistor 316 work in a complementary manner. Accordingly, variations in the pull-up ability are minimized, thereby stabilizing the pull-up ability or current consumption.

That is, if the capacitance of the capacitor 333 increases, a change is delayed in a rising edge of the signal illustrated in FIG. 9C, and the pulse width of the one-shot pulse signal OSPX is lengthened. If the capacitance of the capacitor 333 decreases, a change is quickened in the rising edge of the signal illustrated in FIG. 9C, and the pulse width of the one-shot pulse signal OSPX is shortened.

In addition, if the driving ability of the P-channel MOS transistor 353 is small, a time required for charging and discharging the capacity of the capacitor 333 is lengthened, and the pulse width of the one-shot pulse signal OSPX is lengthened. If the driving ability of the P-channel MOS transistor 353 is great, the time required for charging and discharging the capacity of the capacitor 333 is shortened, and the pulse width of the one-shot pulse signal OSPX is shortened.

In FIG. 7, the P-channel MOS transistor 316 functioning as the pull-up resistor is the P-channel MOS transistor similar to the P-channel MOS transistor 353 of the one-shot pulse signal generation circuit 330. Therefore, characteristics on an integrated circuit show a similar tendency. That is, if the driving ability of the P-channel MOS transistor 353 increases due to variations in the manufacturing process, the driving ability of the P-channel MOS transistor 316 also increases. In addition, if the driving ability of the P-channel MOS transistor 353 increases due to an influence such as a temperature change, the driving ability of the P-channel MOS transistor 316 also increases.

In a case where the driving ability of the P-channel MOS transistor 353 of the one-shot pulse signal generation circuit 330 is great, the pulse width of the one-shot pulse signal OSPX is shortened. If the pulse width of the one-shot pulse signal OSPX is shortened, the pull-up ability of the P-channel MOS transistor 316 tends to become poor. However, each driving ability of the P-channel MOS transistor 353 and the P-channel MOS transistor 316 shows a similar tendency. Therefore, if the driving ability of the P-channel MOS transistor 353 increases, the driving ability of the P-channel MOS transistor 316 also increases. For this reason, the poor pull-up ability caused by the shortened pulse width of the one-shot pulse signal OSPX is offset by the increased driving ability of the P-channel MOS transistor 316. Therefore, the pull-up ability does not vary greatly.

In addition, in a case where the driving ability of the P-channel MOS transistor 353 of the one-shot pulse signal generation circuit 330 is small, the pulse width of the one-shot pulse signal OSPX is lengthened. If the pulse width of the one-shot pulse signal OSPX is lengthened, the P-channel MOS transistor 316 tends to increase the currents. However, each driving ability of the P-channel MOS transistor 353 and the P-channel MOS transistor 316 shows a similar tendency. Therefore, if the driving ability of the P-channel MOS transistor 353 decreases, the driving ability of the P-channel MOS transistor 316 also decreases, thereby reducing the currents flowing in the P-channel MOS transistor 316. For this reason, the increased currents caused by the lengthened pulse width of the one-shot pulse signal OSPX are offset by the reduced currents in the P-channel MOS transistor 316. Therefore, the current consumption does not vary greatly.

In addition, in the one-shot pulse signal generation circuit 330 according to the present embodiment, the capacitor 333 employs capacitance using a gate oxide film. Therefore, similarly to the first embodiment, the capacitance of the capacitor 333 and the driving ability of the P-channel MOS transistor 353 work in a complementary manner, thereby minimizing variations in the pulse width of the one-shot pulse signal OSPX.

That is, the capacitor 333 of the one-shot pulse signal generation circuit 330 employs the capacitance using the gate oxide film. Accordingly, if the gate oxide film is thickened, the capacitance decreases. If the capacitance of the capacitor 333 decreases, the pulse width of the one-shot pulse signal OSPX tends to be shortened. However, if the gate oxide film is thickened in the capacitor 333 of the one-shot pulse signal generation circuit 330, in response to the thickened gate oxide film, the gate oxide film of the P-channel MOS transistor 353 configuring the inverter 332 is also thickened. If the gate oxide film of the P-channel MOS transistor 353 is thickened, the driving ability of the P-channel MOS transistor 353 becomes poor. Therefore, a time required for charging and discharging the capacitor 333 is lengthened, and the pulse width of the one-shot pulse signal OSPX tends to be lengthened. In this way, the gate oxide film is thickened, and the capacitance of the capacitor 333 decreases. Accordingly, even if the pulse width of the one-shot pulse signal OSPX is shortened, the shortened pulse width is offset by the poor driving ability of the P-channel MOS transistor 353, thereby minimizing variations in the pulse width of the one-shot pulse signal OSPX.

Furthermore, a depletion layer is prevented from spreading by arranging a highly impure region under the gate oxide film, thereby reducing variations in a capacitance value with respect to a gate voltage. Accordingly, it is possible to further minimize the variations in the pulse width of the one-shot pulse signal OSPX.

As described above, the electronic timepiece 100 according to the present embodiment includes the crown switch 311 serving as the first switch connected to the signal line 312, the P-channel MOS transistor 316 serving as the second switch, and the one-shot pulse signal generation circuit 330. The crown switch 311 is inserted into the signal line 312, and one end of the P-channel MOS transistor 316 is connected to the signal line 312 on the rear stage of the crown switch 311. The other end of the P-channel MOS transistor 316 is connected to the reference potential Vdd. The one-shot pulse signal generation circuit 330 generates the one-shot pulse signal OSPX by using the reference clock signal SMP, and the P-channel MOS transistor 316 is controlled by the one-shot pulse signal OSPX.

According to this configuration, when the crown 104 is pulled out and the crown switch 311 is turned on, the currents flowing in the pull-up resistor can be considerably reduced. In this manner, in a case where the electronic timepiece 100 is displayed by pulling out the crown 104 in a store, it is possible to prolong the battery life.

In addition, the electronic timepiece 100 according to the present embodiment includes the oscillator circuit 2, and the clocking unit 6 that clocks a time, based on the frequency in which the frequency obtainable from the oscillator circuit 2 is divided. The reference clock signal SMP is configured to include the frequency in which the frequency obtainable from the oscillator circuit 2 is divided. The first switch (crown switch 311) is a switch for operating the crown 104 so as to select a connection state and a disconnection state.

In addition, in the electronic timepiece 100 according to the present embodiment, the one-shot pulse signal generation circuit 330 includes the first inverter 331, the second inverter 332, the capacitor 333, and the NOR gate 334. The reference clock signal SMP is input to the input terminal of the first inverter 331, and the input terminal of the second inverter 332 and one input terminal of the NOR gate 334 are connected to the output terminal of the first inverter 331. One end of the capacitor 333 and the other input terminal of the NOR gate 334 are connected to the output terminal of the second inverter 332. The other end of the capacitor 333 is connected to the reference potential. Based on the output signal of the NOR gate 334, the one-shot pulse signal generation circuit 330 generates a low level signal having a period shorter than a period while the reference clock signal SMP is in a low level.

According to this configuration, a pulse signal having a short period of a low level is generated without using a high frequency signal. In this manner, the pull-up resistor can be intermittently driven, and power consumption can be reduced. In addition, similarly to the first embodiment, the pulse signal having a short period is generated by using the reference clock signal SMP which is generated from the oscillation frequency of 32 kHz by the quartz resonator included in the oscillator circuit 2 of the electronic timepiece 100, and the pull-up resistor can be intermittently driven. Accordingly, without requiring the high frequency dedicated to the intermittent driving, reduced power consumption can be efficiently realized. The crown switch detection circuit 1B configured according to the present invention is employed. Accordingly, while a circuit scale is reasonably minimized, the pull-up resistor can be intermittently driven by using the above-described oscillation frequency and the pulse having the very short period.

In addition, in the electronic timepiece 100 according to the present embodiment, the capacitor 333 is formed by the capacitance using the gate oxide film. The P-channel MOS transistor 353 configuring the second inverter 332 delays rising of the reference clock signal SMP by charging and discharging the capacitor 333. The pulse width during a period while the one-shot pulse signal OSPX is in a high level is determined by the capacitance of the capacitor 333 and the driving ability of the P-channel MOS transistor 353 configuring the second inverter 332.

According to this configuration, the driving ability of the P-channel MOS transistor 353 configuring the second inverter 332 and the capacitance of the capacitor 333 are offset by each other. Accordingly, it is possible to minimize variations in the pulse width. In addition, a change in the capacitor 333 and a change in the driving ability of the P-channel MOS transistor 316 functioning as the pull-up resistor are offset by each other. Accordingly, variations in the pull-up ability are minimized, thereby stabilizing the pull-up ability or current consumption.

In addition, in the electronic timepiece 100 according to the present embodiment, the P-channel MOS transistor 316 serving as the second switch is used as the first pull-up resistor, thereby controlling the function of the P-channel MOS transistor 316 in accordance with the one-shot pulse signal OSPX.

According to this configuration, the first pull-up resistor can be intermittently driven in such a way that the P-channel MOS transistor 316 functioning as the second switch is used as the first pull-up resistor.

In addition, in the electronic timepiece 100 according to the present embodiment, the P-channel MOS transistor 317 functioning as the second pull-up resistor is inserted between the signal line 312 and the reference potential Vdd, thereby controlling the function of the P-channel MOS transistor 317 in accordance with the output level and the system reset signal SRX of the signal line 312.

According to this configuration, while the crown switch 311 is turned off, the signal line 312 is pulled up by the P-channel MOS transistor 317 functioning as the second pull-up resistor. In this manner, the electronic timepiece 100 can be hardly affected by noise.

In addition, in the electronic timepiece 100 according to the present embodiment, the N-channel MOS transistor 322 serving as the third switch for connecting the signal line 312 and the power source Vss is inserted between the signal line 312 and the power source Vss, thereby operating the N-channel MOS transistor 322 with the P-channel MOS transistor 316 in a complementary manner.

According to this configuration, while the crown switch 311 is turned on, a signal level of the signal line 312 can be maintained in a low level by the N-channel MOS transistor 322 functioning as the third switch.

Hitherto, the embodiments according to the present invention have been described in detail. However, specific configurations are not limited to the embodiments, and the present invention also includes a change in design within the scope of the appended claims.

What is claimed is:

1. An electronic timepiece comprising:

a first switch that is connected to a signal line;

a second switch; and a one-shot pulse signal generation circuit, wherein the first switch is inserted into the signal line, wherein one end of the second switch is connected to the signal line at a rear stage of the first switch, wherein the other end of the second switch is connected to a power source, wherein the one-shot pulse signal generation circuit generates a one-shot pulse signal by using a reference clock signal, wherein the second switch is controlled by the one-shot pulse signal, wherein the one-shot pulse signal generation circuit includes a first inverter, a second inverter, a capacitor, and a NAND gate, wherein the reference clock signal is input to an input terminal of the first inverter, and an input terminal of the second inverter and one input terminal of the NAND gate are connected to an output terminal of the first inverter, wherein one end of the capacitor and the other input terminal of the NAND gate are connected to an output terminal of the second inverter, wherein the other end of the capacitor is connected to a reference potential, and wherein based on an output signal of the NAND gate, the one-shot pulse signal generation circuit generates a high level signal having a period shorter than a period while the reference clock signal is in a high level.

2. The electronic timepiece according to claim 1, further comprising:

an oscillator circuit that generates an oscillation signal having a predetermined frequency;

a frequency divider circuit that frequency divides the oscillation signal; and a clocking unit that clocks time based on a frequency-divided signal from the frequency divider circuit, wherein the reference clock signal is a frequency-divided signal from the frequency divider circuit different from the frequency-divided signal used by the clocking unit to clock time, and wherein the first switch selects a connection state and a disconnection state by operating a crown.

3. The electronic timepiece according to claim 1 wherein the capacitor includes a gate oxide film, wherein a transistor configuring the second inverter delays falling of the reference clock signal by charging and discharging the capacitor, and wherein a pulse width during a period while the one-shot pulse signal is in a high level is determined by the capacitance of the capacitor and driving ability of the transistor configuring the second inverter.

4. The electronic timepiece according to claim 1, wherein the second switch is used as a first pull-down resistor so as to control a function of the first pull-down resistor in accordance with the one-shot pulse signal.

5. The electronic timepiece according to claim 4, wherein a second pull-down resistor is inserted between the signal line and the power source so as to control a function of the second pull-down resistor in accordance with an output level and a reset signal of the signal line.

6. The electronic timepiece according to claim 5, wherein a third switch for connecting the signal line and the reference potential is inserted between the signal line and the reference potential so as to operate the third switch with the second switch in a complementary manner.

7. The electronic timepiece according to claim 1, wherein a first pull-down resistor is inserted between the signal line and the second switch so as to control a function of the first pull-down resistor in accordance with the one-shot pulse signal.

8. An electronic timepiece comprising:

a first switch that is connected to a signal line;

a second switch; and a one-shot pulse signal generation circuit, wherein the first switch is inserted into the signal line, wherein one end of the second switch is connected to the signal line at a rear stage of the first switch, wherein the other end of the second switch is connected to a reference potential, wherein the one-shot pulse signal generation circuit generates a one-shot pulse signal by using a reference clock signal, wherein the second switch is controlled by the one-shot pulse signal, wherein the one-shot pulse signal generation circuit includes a first inverter, a second inverter, a capacitor, and a NOR gate, wherein the reference clock signal is input to an input terminal of the first inverter, and an input terminal of the second inverter and one input terminal of the NOR gate are connected to an output terminal of the first inverter, wherein one end of the capacitor and the other input terminal of the NOR gate are connected to an output terminal of the second inverter, wherein the other end of the capacitor is connected to a reference potential, and wherein based on an output signal of the NOR rate, the one-shot pulse signal generation circuit generates a low level signal having a period shorter than a period while the reference clock signal is in a low level.

9. The electronic timepiece according to claim 8, further comprising:

an oscillator circuit; that generates an oscillation signal having a predetermined trequency;

a frequency divider circuit that frequency divides the oscillation signal; and a clocking unit that clocks time based on a frequency-divided signal from the frequency divider circuit, wherein the reference clock signal is is a frequency-divided signal from the frequency divider circuit different from the frequency-divided signal used by the clocking unit to clock time, and wherein the first switch selects a connection state and a disconnection state by operating a crown.

10. The electronic timepiece according to claim 8, wherein the capacitor includes a gate oxide film, wherein a transistor configuring the second inverter delays rising of the reference clock signal by charging and discharging the capacitor, and wherein a pulse width during a period while the one-shot pulse signal is in a low level is determined by the capacitance of the capacitor and driving ability of the Lransistor configuring the second inverter.

11. The electronic timepiece according to claim 8, wherein the second switch is used as a first pull-up resistor so as to control a function of the first pull-up resistor in accordance with the one-shot pulse signal.

12. The electronic timepiece according to claim 11, wherein a second pull-up resistor is inserted between the signal line and the reference potential so as to control a function of the second pull-up resistor in accordance with an output level and a reset signal of the signal line.

13. The electronic timepiece according to claim 12, wherein a third switch for connecting the signal line and the power source is inserted between the signal line and the power source so as to operate the third switch with the second switch in a complementary manner.

* * * * *